US006979185B2

(12) United States Patent
Kaempe

(10) Patent No.: US 6,979,185 B2
(45) Date of Patent: Dec. 27, 2005

(54) BI-ROTATIONAL PUMP/HYDRAULIC ACTUATOR

(76) Inventor: Staffan I. Kaempe, 2209 E. Hwy. 150, Paoli, IN (US) 47454

( * ) Notice: Subject to any disclaimer, the term of this patent is extended or adjusted under 35 U.S.C. 154(b) by 0 days.

(21) Appl. No.: 09/916,091

(22) Filed: Jul. 26, 2001

(65) Prior Publication Data

US 2002/0127126 A1 Sep. 12, 2002

Related U.S. Application Data

(60) Provisional application No. 60/222,290, filed on Aug. 1, 2000.

(51) Int. Cl.[7] ..... F03C 2/00

(52) U.S. Cl. ..... 418/131; 418/133; 418/206.1; 418/206.4; 60/475; 60/476

(58) Field of Search ..... 418/131, 132, 418/206.1, 133, 206.4; 60/475, 476

(56) References Cited

U.S. PATENT DOCUMENTS 2,457,467 A * 12/1948 Hartman ..... 60/476
2,927,429 A * 3/1960 Martin ..... 60/475
2,936,717 A * 5/1960 Kalle ..... 418/131
3,263,425 A * 8/1966 Rohde ..... 60/475
3,280,756 A * 10/1966 Gordon ..... 418/132
3,481,275 A * 12/1969 Gelin ..... 418/133
4,127,365 A * 11/1978 Martin et al. ..... 418/131
4,465,444 A * 8/1984 Dworak et al. ..... 418/132
4,606,713 A * 8/1986 Lipscombe ..... 418/132
5,144,801 A * 9/1992 Scanderbeg et al. ..... 60/475
6,152,715 A * 11/2000 Kaempe et al. ..... 418/132

FOREIGN PATENT DOCUMENTS

CH 350877 * 1/1961 ..... 418/131
JP 60-75783 * 4/1985 ..... 418/132

* cited by examiner

*Primary Examiner*—Theresa Trieu
(74) *Attorney, Agent, or Firm*—Paul F. Stutz

(57) ABSTRACT

A novel bi-rotational pump adapted to pump fluid in either of two directions by reason of construction inclusive of passageways and an array of check valves and pilot pistons which cooperate in one direction and in another way in the other direction.

4 Claims, 21 Drawing Sheets

BI-ROTATIONAL PUMP/HYDRAULIC ACTUATOR

The inventions disclosed herein are disclosed and described in a prior Provisional Application entitled "DEVICE/SYSTEM FOR MOVING FLUIDS", filed Aug. 1, 2000 and identified as Ser. No. 60/222,290. Applicant expresses herein his intention that the present Application may rely upon the filing date of Aug. 1, 2000 of his Provisional Application as a priority date for all purposes.

BACKGROUND

The present inventions relate to novel mechanisms, and, as well, systems for moving fluids in a controllable, precise, accurate and advantageous fashion, generally for the purpose of developing a liquid or hydraulic pressure which will actuate a piston and piston rod to move in either of two directions; extend or retract.

For purposes of description herein the device will be described as driven by a direct current motor controlled by a three position switch or relay by which current is directed appropriately to yield motor shaft movement either clockwise, counterclockwise, or stop or at rest position.

More particularly the present invention relates to a novel and unique pump which is bi-rotational. By bi-rotational is meant a pump that has two pressure outlets connectable to opposite ends of a hydraulic cylinder containing a movable piston rod and piston therewithin capable of moving in directions as controlled by the pumps rotational movement. As indicated above the pumps rotational direction is herein described as effected by a direct current electric motor whose drive shaft rotation is dependent upon the electrical connection effected by the three-position switch or relay. Reversing polarity will reverse rotation. As can be appreciated the to and fro motion of the piston rod is of utility in effecting controlled reciprocal movement of a variety of elements as more particularly and detailedly described hereinafter.

The present invention relates most particularly to a hydraulic bi-rotational pump embodying novel feature of structure and operation which allows achievement and simplicity of operation beyond that anything known at the present time; and being capable of being constructed very small which permits its utilization in a manner unknown to the present time.

Gear pumps, of course, are well known in the art and need no present detailed description. Gear pumps are generally constructed of two intermeshing gears located in a cavity having an inlet and an outlet. In the gear pump of the present invention the structure is of such novelty and unique design as provide an inlet for the pump in the usual fashion but in accordance with the present invention has two outlets. One outlet is used to convey hydraulic oil or develop pressure through one outlet, depending on a clockwise rotation of the motor and the connected shaft on which is mounted the intermeshing gear. The other outlet is used to direct fluid pressure pursuant to counterclockwise rotation of the DC motor shaft and the connected drive shaft bearing the gears and controlling the movement and rotation of the intermeshing gears.

The novelty of the present pump may be described as due in part to its constructional details consisting of multiple parts located in flush side by side relationship; on either side of the housing containing the intermeshing gears; said side by side parts being machined to contain a novel arrangement of internal passageways interrupted by moveable ball type check valves and piston actuated valves; all operating in cooperative relationship to direct the appropriate fluid, usually a hydraulic oil, out one or the other of the two outlets connected by appropriate passageways/conduits to opposite ends of a cylinder or actuator containing the usual piston rod and piston arrangement.

The construction is such that instant and positive change of direction of the piston is achieved by appropriate actuation of the drive motor and controlled by the three-position switch, accomplishing appropriate direction of the hydraulic fluid to one side or the other of the piston in the actuator cylinder. The design and interrelationship of these cooperating parts and features are such that the entire pump body is surrounded by the hydraulic fluid and the size of the pump is extremely small (as described in more detail hereinafter) such that it can be fabricated of a large selection of materials of construction (aluminum preferred) and of a size as permits desired utilitarian functionality in a variety of applications.

While the pump of the present invention may be fabricated/constructed of a variety of materials including metals, engineering plastics, acrylonitrile/butadiene/styrene (ABS) tripolomers, etc.; aluminum is a preferred material of construction for the pump parts identified hereinafter, with the exception that the oppositely rotatable intermeshing gears and their cavity wherein located is usually desirably formed of steel by reason of its being able to endure the frictional movement of the counter rotating gears within the cavity. The pump of the present invention is desirably fabricated, at the present time (as a preferred mode), to an overall dimension of about two inches (2") in length by about one and one quarter inches (1-1¼") in diameter.

This is remarkably small considering the many unique and sophisticated, constructional details including the passageways which are integral to a successful operation and to the small ball and check valves (with opposing springs in some cases), as also described herein. A currently suitable and appropriate direct current motor may be selected from a variety of generally available, direct current motors whose shaft rotation is dependent upon the electrical connection to the positive and negative terminals.

It is a variant embodiment of the present invention to employ the bi-rotational pump and suitable drive motor by locating both within a hydraulic cylinder/actuator. The latter will also include a piston and piston rod driven/movable by the hydraulic pressure developed by the rotation of the intermeshing gears in the novel bi-rotational pump. The latter as described earlier and illustrated in the drawings includes two outlets which, by reason of the passageways formed in the pump on either side of the gear housing, direct fluid through appropriate passageways, to one side or the other of the piston slidably located in the actuator, so as to accomplish a linear reciprocating movement in turn depending upon the connection (via switch or relay) of the electric direct current to one or the other terminals of the motor. The latter, of course, will result in the rotating of the gears in one direction or then other thus so that pressure will be developed within the pump proper as to direct the hydraulic pressure via outlets/passageways to either one side or the other of the piston.

It will be appreciated that the hydraulic driving gear rotates directly as driven by the shaft of the direct current motor. A cooperating sister gear in intermeshing relationship with the principal driving shaft is mounted on a idler shaft located in parallel relationship with the drive shaft as above.

In accordance with a subsidiary embodiment of the present invention, the bi-rotational hydraulic pump is employed in combination with an actuator, and an electric motor driving the bi-rotational hydraulic pump, all located within the hydraulic cylinder, including provisions for an oil reserve, and forming one compact unit. This unit yields a package with no leaking connectors, no valves to operate and no maintenance over its life. The oil reserve reservoir has no connection with the outside air so no oil will be able to escape through a vent. All exposed material is aluminum except for the piston rod which is fabricated of Nitrotech steel and the electric motor.

In summary, the actuator operates as follows: when the electric D.C. Motor is rotating clockwise, the piston rod is extending from the hydraulic cylinder or actuator. When the motor is rotating counterclockwise, the piston rod is retracting into the actuator cylinder. When the electric motor is off the piston rod is hydraulically locked into position.

The combination of motor, pump, fluid reservoir and cylinder in a single package has very unique utility in constituting therefore a self-contained actuator requiring only a change in the polarity of the motor to achieve a change in the direction of the bi-rotational pump and, through its novel arrangement of passageways and ball valves, a change in the direction of the hydraulic flow such that it passes into the actuator cylinder on one side of the piston or the other.

In this fashion the movement of the piston rod is reversed to effect appropriate movement of the mechanism part or item which is desirable moved reliably in reciprocal, to and fro fashion.

A unique and novel feature and utilitarian feature is that the totality of the cylinder, of the motor and the pump in accordance with the present invention weighs little more than a conventional hydraulic cylinder for the same application.

This embodiment of the present invention wherein the novel bi-rotational pump, the hydraulic cylinder and including the drive motor in one cylinder finds particular utility in the field of recreational vehicles to control the sliding/reciprocating movement of rooms or levelers or letdown shades etc.

It can also be used in the transportation field eg. cars, vans, buses and including paraplegic lifts. The cylinder, referred to as an actuator, is also usable in lift gates, cranes, and support legs in the truck equipment business.

In the general field of industry the bi-rotational pump and reciprocal piston rod finds its utility as a door closer, as an opener of skylights, and in positioning fixturing, materials handling. Further in the field of automotive and specifically garden tractors the device is used in deck lifts as well as three-point hitch lifts. In the field of material handling, the device, in the form of the reciprocable piston controlled by hydraulic fluid described hereinabove and in more detail hereinafter finds utility in controlling belt lifts, material clamping, scissors lifts, as well as conveyor control.

In the marine environment these devices find wide acceptance in the field of driving of tilt trims, trim tabs, or the opening of skylights, etc. In the field of agriculture the device is eminently utilitarian in the control of support legs, auger control, gate closers, and implement lifts.

Presently available gear pumps are largely unsuitable in the applications described, by reason of their larger size, heavier weight, and their general inaccuracy and lack of close control as compared to the bi-rotational pumps of the present invention and as compared to the combination of the bi-rotational pump and actuator and electric motor in one compact cylinder as described herein.

OBJECT

With the foregoing introduction it is a principal object of the present invention to provide a novel and unique bi-rotational pump of such features of construction as allow it to be produced in extremely small sizes.

It is another object of the present invention to provide such a novel pump which by reason of the range of materials of construction allowable by reason of the design of the present invention permits the pump to be manufactured to extremely close tolerances which results in considerable savings of weight yielding a pump which is lighter than provided by the conventional pumps of the present art.

It is a further object of the present invention to provide combinations of the bi-rotational pump with other hydraulically driven systems as do not presently exist on the market today.

It is a further object of the present invention to provide a bi-rotational multi-component pump having features of interior structure inclusive of passageways and means controlling flow of fluid in these passageways which extrapolates to a balancing of hydraulic forces axially and radially acting on the pump interiorly and exteriorly. Thus less material is needed for a structurally sound pump than what has been possible with prior art pumps. This results in a much smaller and lighter pump. Thus normally the gear housing must be made or fabricated of a greater wall thickness whereby weight is greater than with the design of the present invention.

It is still another object of the present invention to provide a modified bi-rotational pump device which is extremely utilitarian and capable of being associated with and combined with a diverse variety of cooperating mechanical components and electronic components such as to improve the functioning of the cooperating mechanical components eg. exhibiting reciprocal movement.

The foregoing objects and, as well, other objects of the present invention will become apparent to those skilled in the art from the following detailed description, taken in conjunction with the annexed sheets of drawings inconclusive of eighteen (18) FIG, labeled FIGS. 1–18 and supplemental drawings, labeled FIG. 19, FIG. 20, FIG. 21 and FIG. 22. FIGS. 1 thru 18 exist for purposes of illustration only and not to limit the scope of the invention. In other words, the Figures illustrate preferred embodiments of the present invention that are not to be interpreted as limited unless violative of the scope of the claims appended to this Application.

FIGS. 3, 4, 5, and 6 illustrate schematically the functional operation of the present invention from a hydraulic point of view.

FIGS. 7 thru 18 illustrate the present actual best mode of the many embodiments of the present invention in term of actual constructional details which are desirable for purposes of achieving the objects of the present invention as set forth herein, and, as well, other manifestly obvious alternatives and equivalents.

IN THE DRAWINGS

Figure 1:
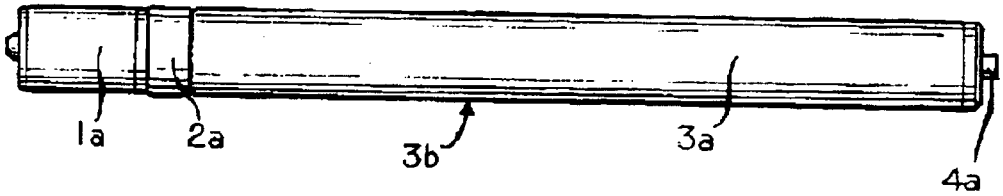
FIG. 1 is a side elevation view of an actuator assembly including a direct current motor, a bi-rotational pump, in accordance with a preferred embodiment of the present invention, and the axially-connected hydraulic actuator cylinder shown in a retracted position.
Figure 2:
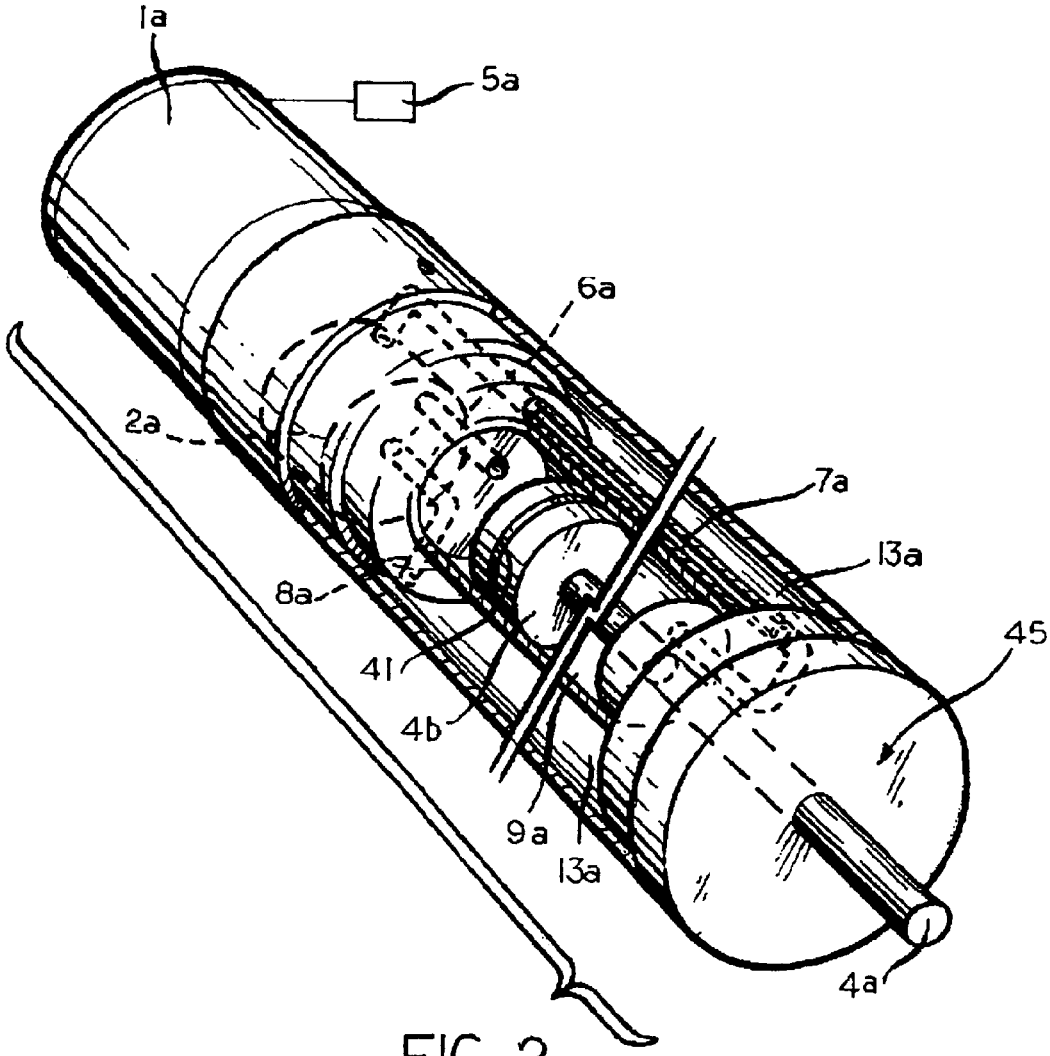
FIG. 2 is a perspective and partially broken away, view of the assembly shown in FIG. 1.
Figure 3:
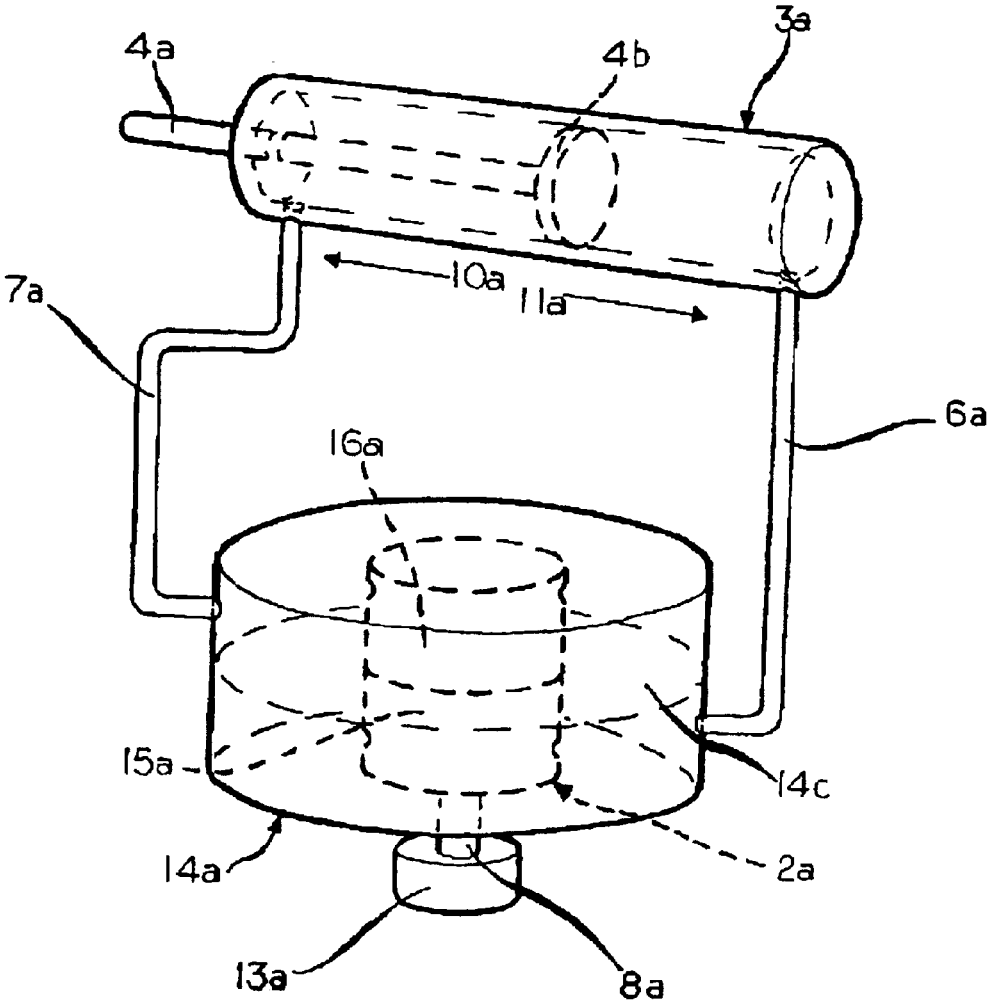

FIG. 3 is a schematic drawing showing the pump and actuator components of FIGS. 1 and 2 in perspective relationship, but displayed in spaced apart relationship for purpose of illustrating the flow of hydraulic fluid and its intended purpose of actuating the actuator via the bi-rotational pump movement/pressurization of the hydraulic fluid. The pump and actuator components of FIG. 1 and 2 are shown fluidly connected.

Figure 4:
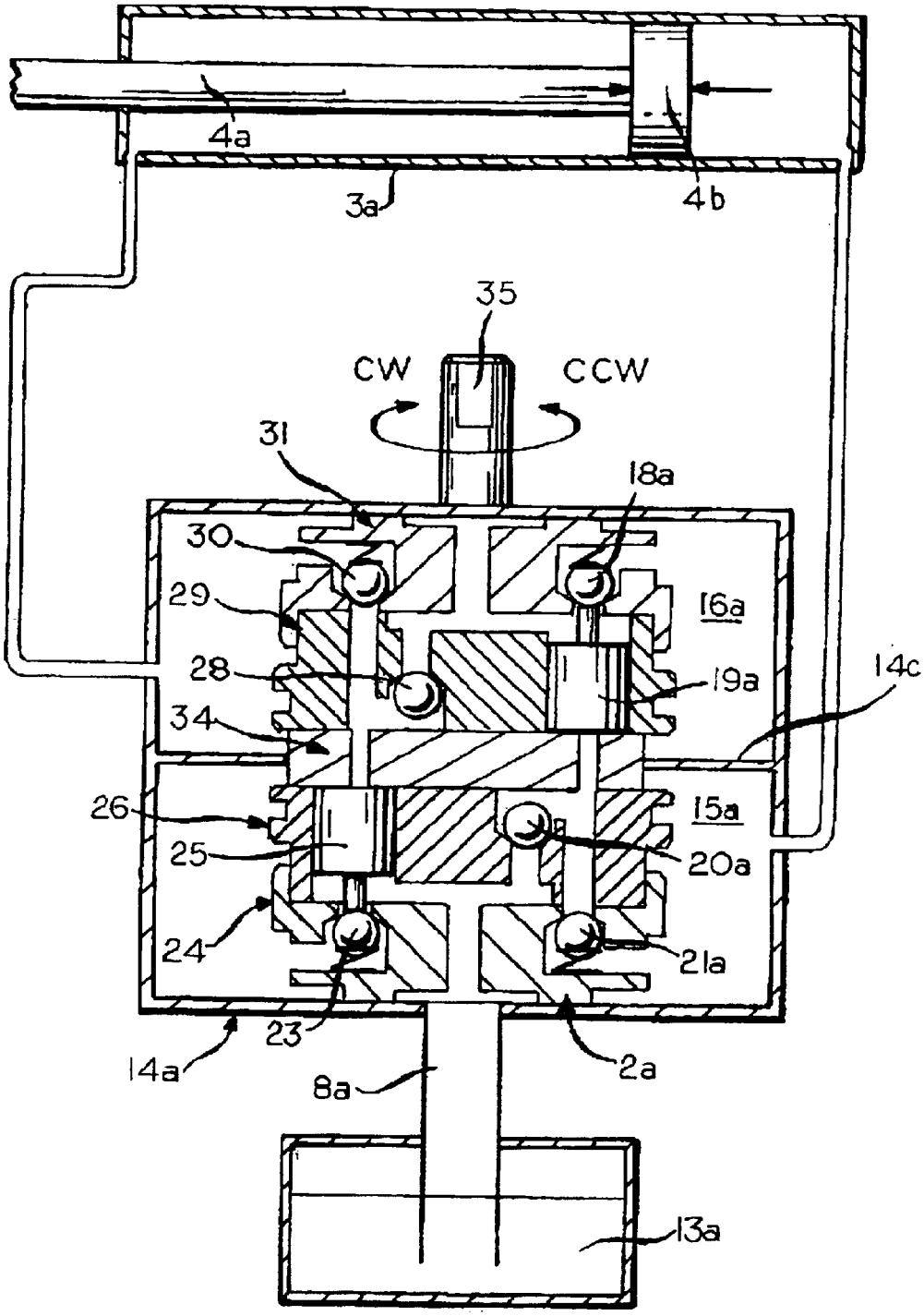

FIG. 4 is a schematic view of the components of FIG. 3 but being a sectional rendition for purposes of showing the interior of the pump and actuator situated thereabove and particularly the relationship of the bi-rotational pump parts or components including its interior ball valves, check valves, etc., etc., controlling the direction of flow of fluid, via the ball valves, check valves etc. positioned as shown. In this position the pump is locked, as indicated on the drawings and, of course, the hydraulic cylinder and piston are also locked.

Figure 5:
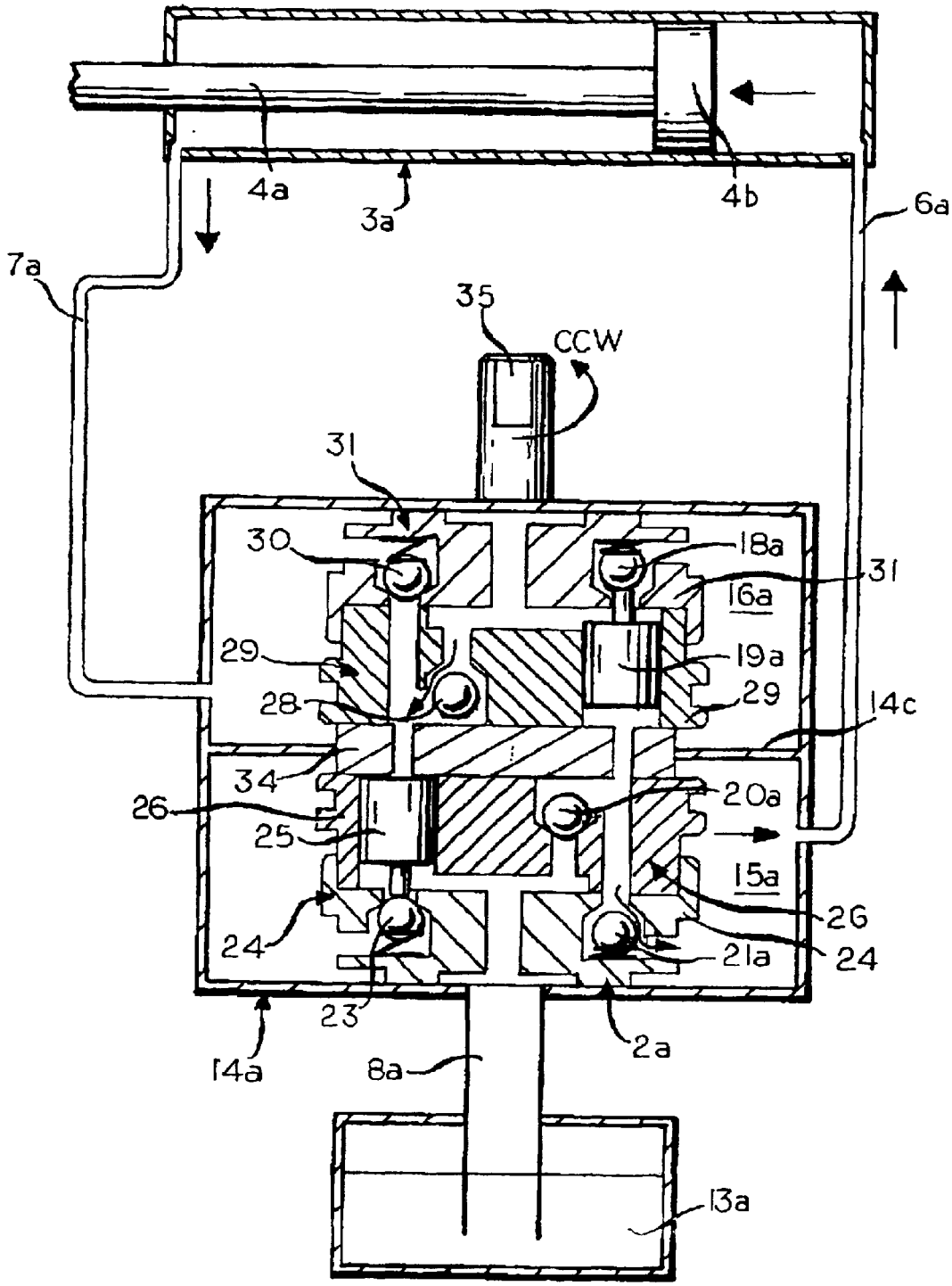

FIG. 5 is a view like FIG. 4 but with the component parts e.g. ball valves, check valves, etc. shown in operative relationship/fashion for actuating the piston into its retracted position.

Figure 6:
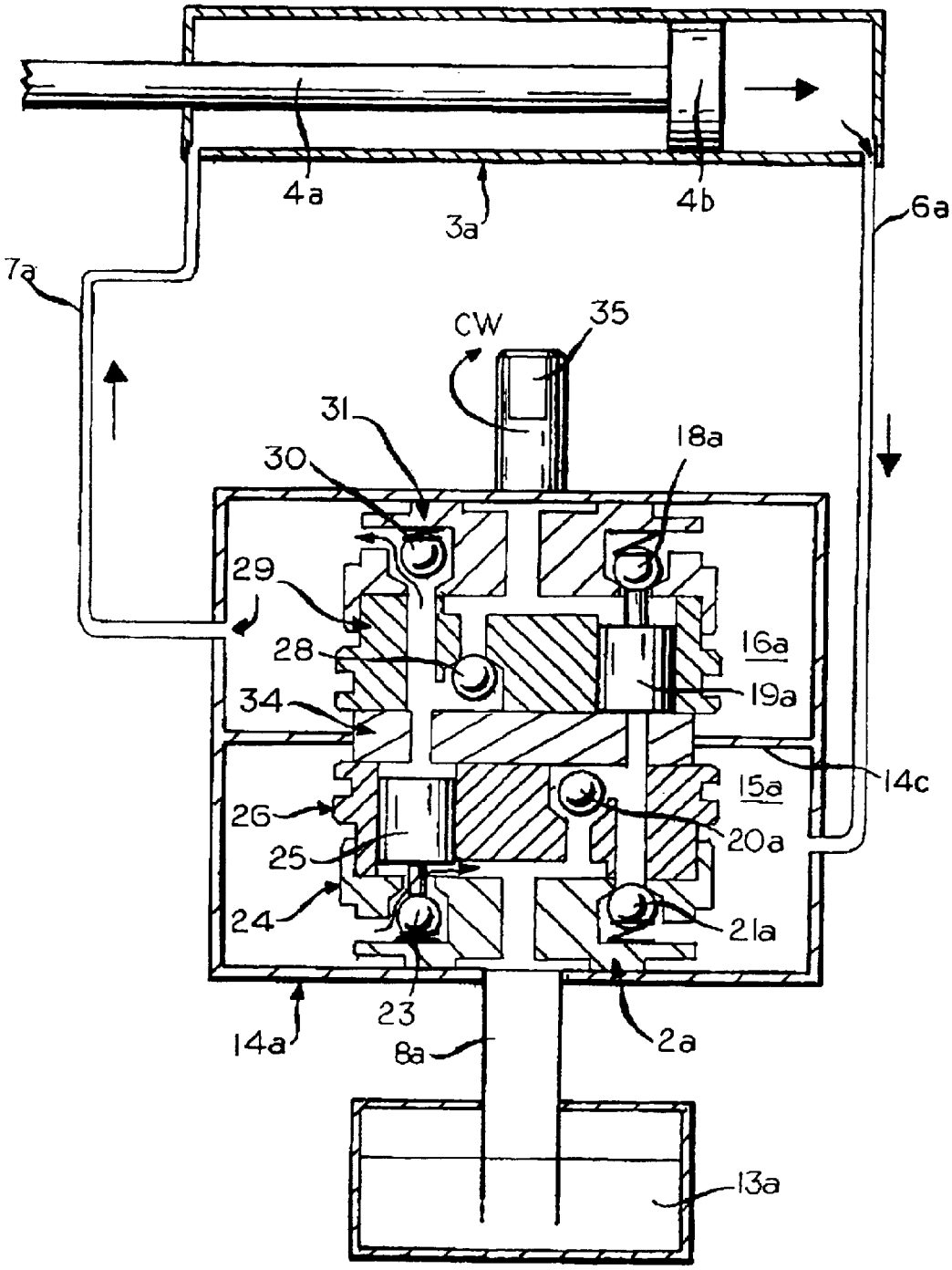

FIG. 6 is a sectional view like FIGS. 4 and 5 but with the component parts e.g. ball valves, check valves, etc. shown in operative relationship/fashion for actuating the piston into its extended position.

[In FIGS. 4, 5 and 6 the movement of the piston in the cylinder or actuator is opposite to that illustrated in FIG. 2.]

Figure 7:
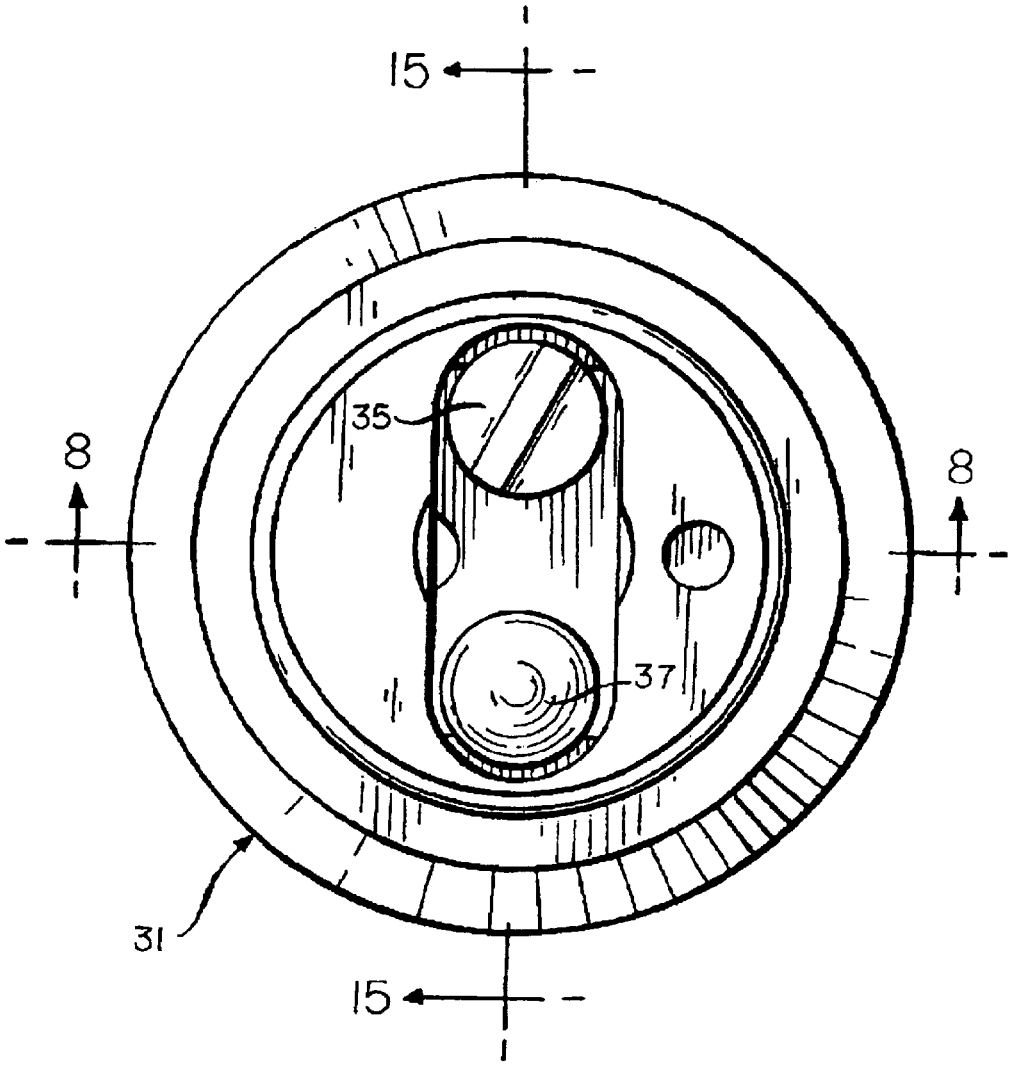
Figure 15:
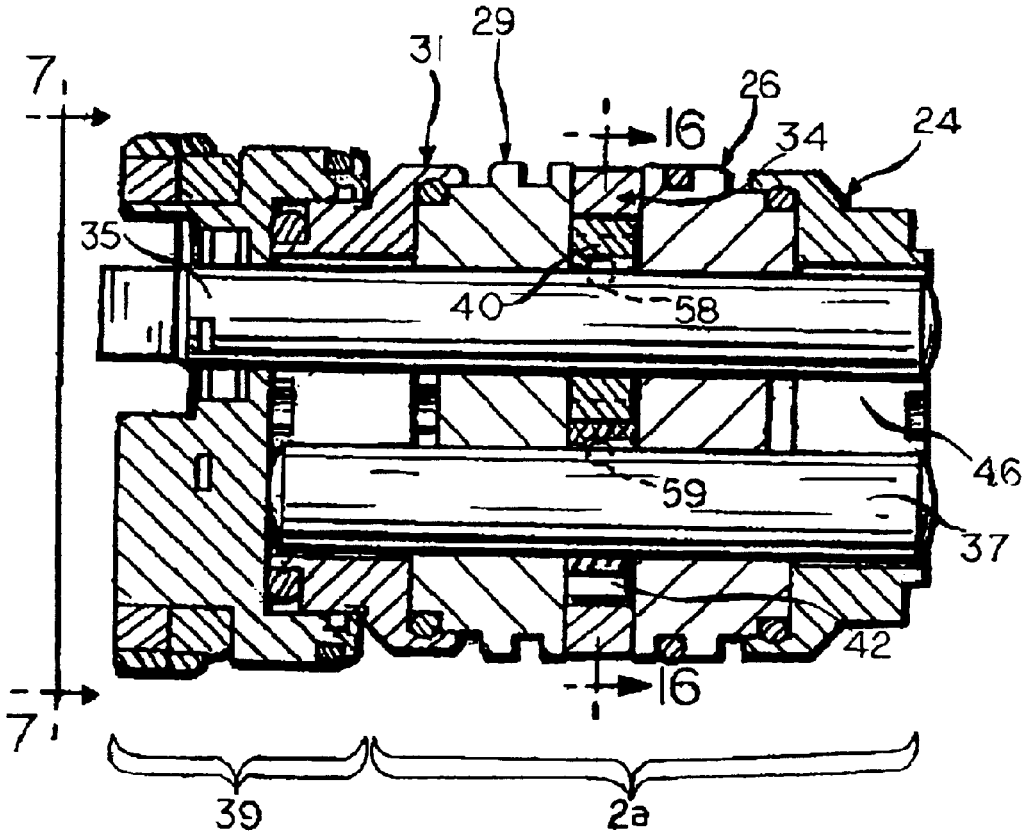

FIG. 7 is a sectional view taken on the Line 7–7' of FIG. 15.

Figure 8:
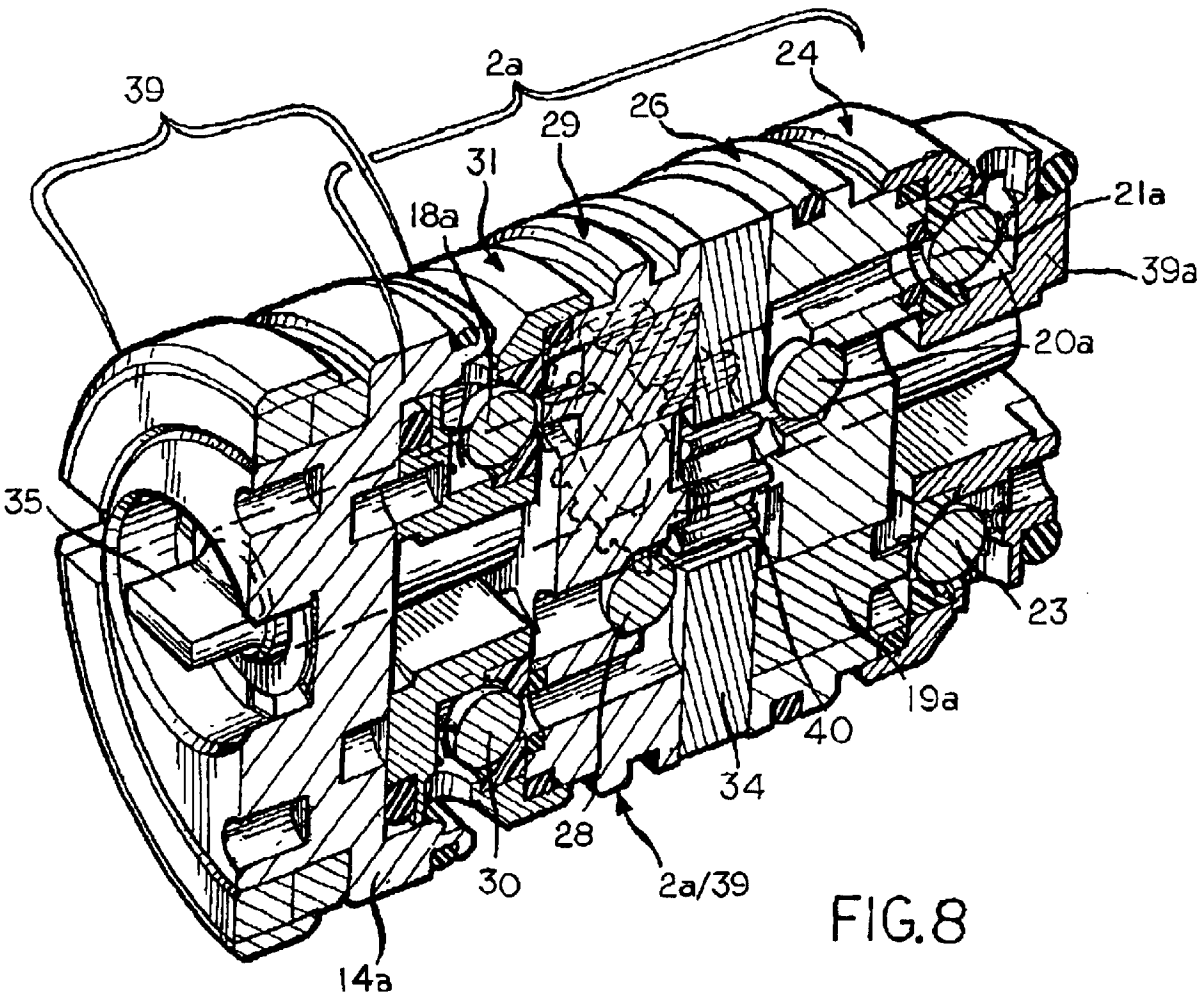

FIG. 8 is a sectional perspective view taken (on the Line 8–8' of FIG. 7) and is a view of the top one half of the pump held between pump retainers as described more particularly hereinafter.

Figure 9:
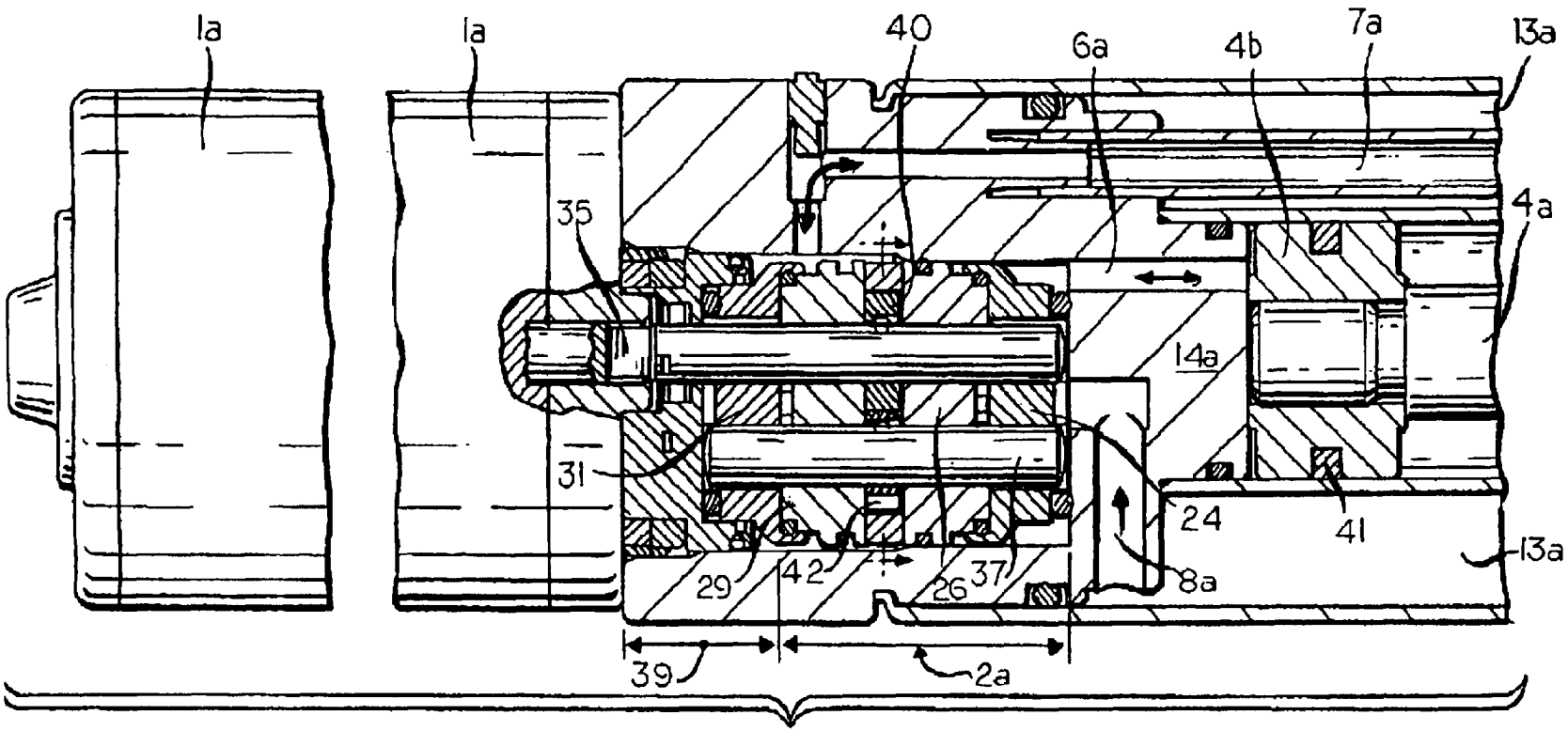

FIG. 9 is an enlarged vertical partially sectional) view of the left one half of the apparatus shown in FIG. 1, and particularly showing the interior of the pump and its surrounding components.

Figure 10:
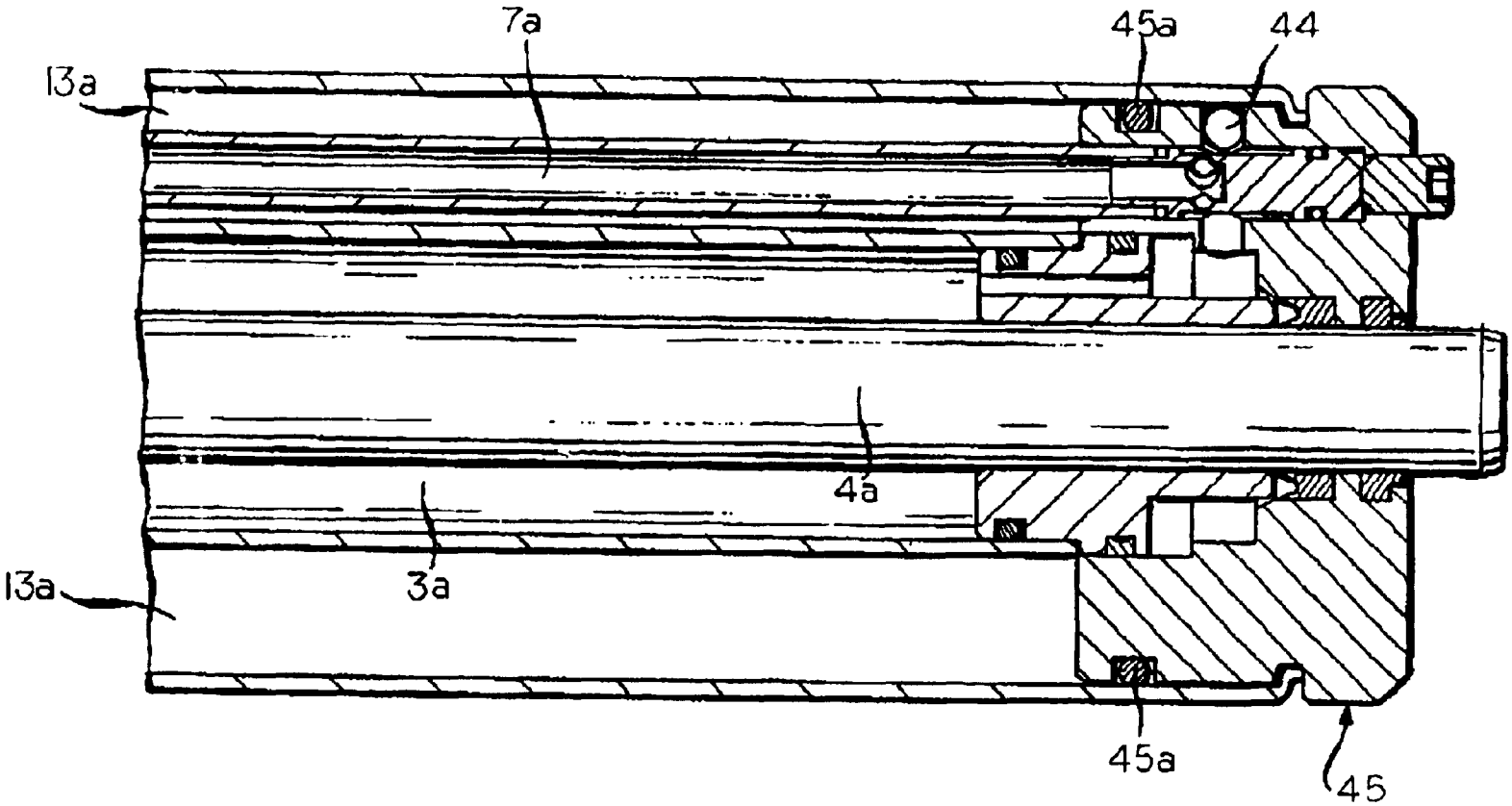

FIG. 10 is a view like FIG. 9 but is of the right-hand segment of the apparatus shown in FIG. 1.

Figure 11:
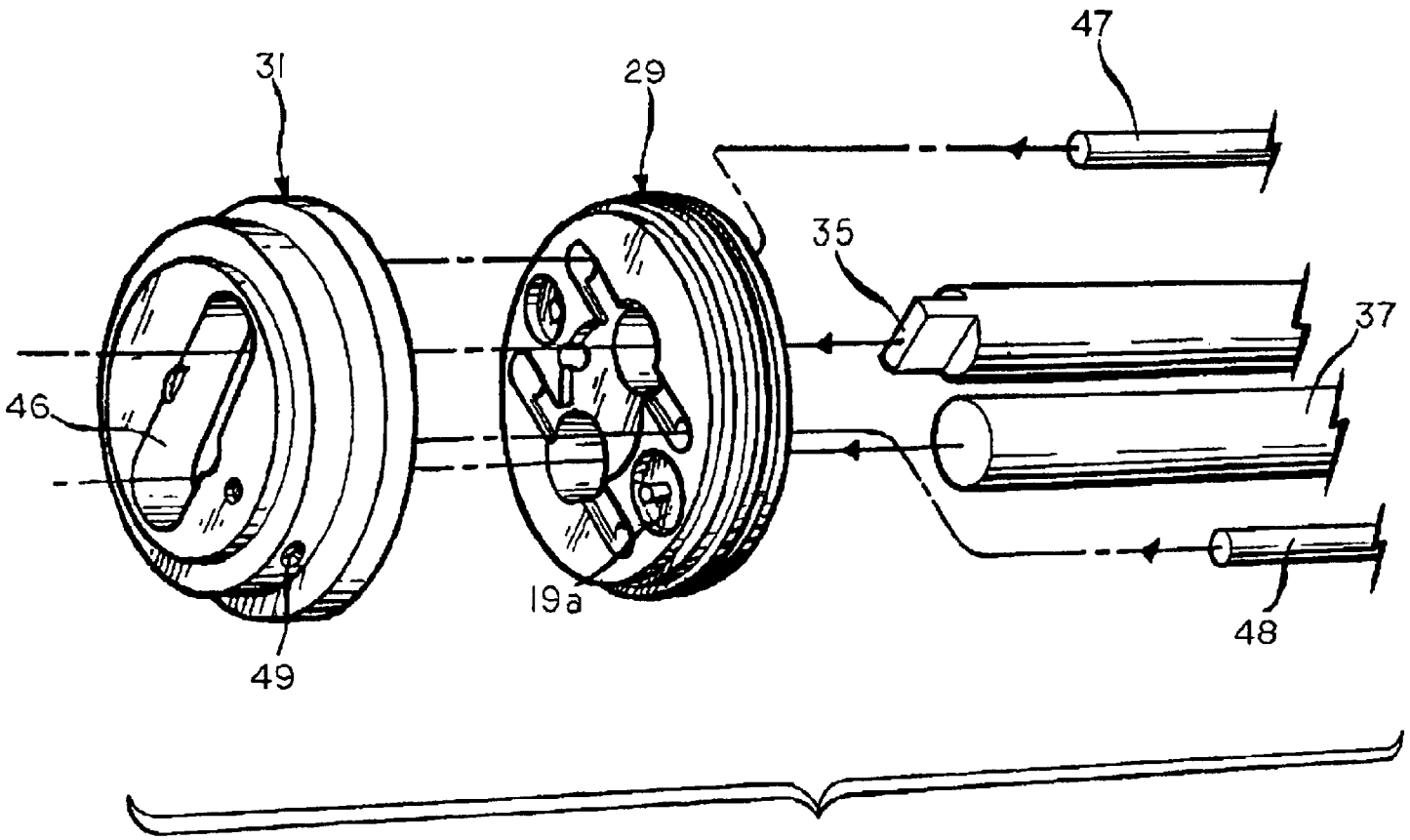

FIG. 11 is a perspective view of the pump parts located at the drive end or left side of the pump and being shown in relative exploded relationship for clarity of illustration.

Figure 12:
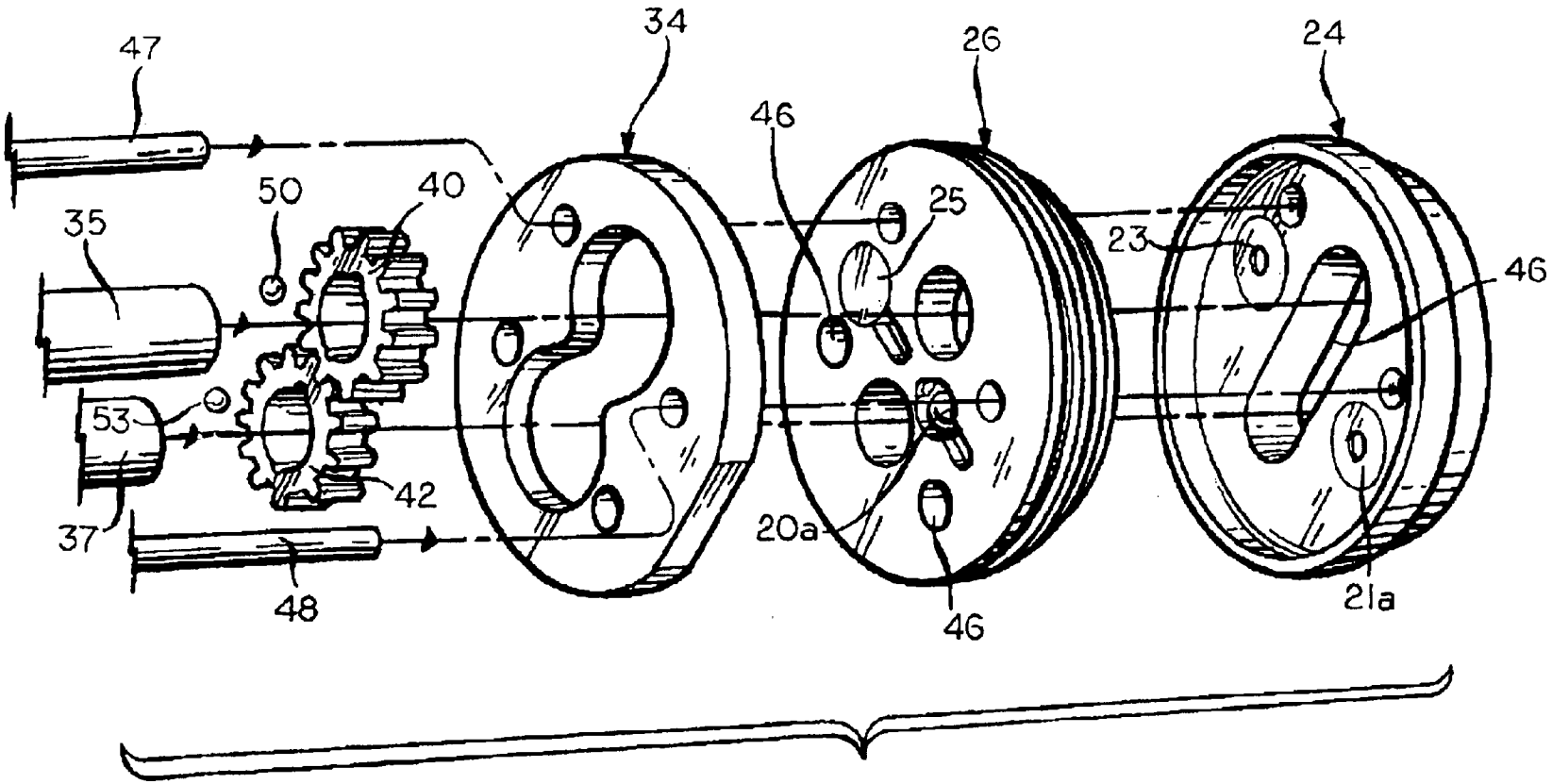

FIG. 12 is a perspective view of the component parts of the right hand side of the pump shown in relative exploded relationship for clarity of illustration.

Figure 13:
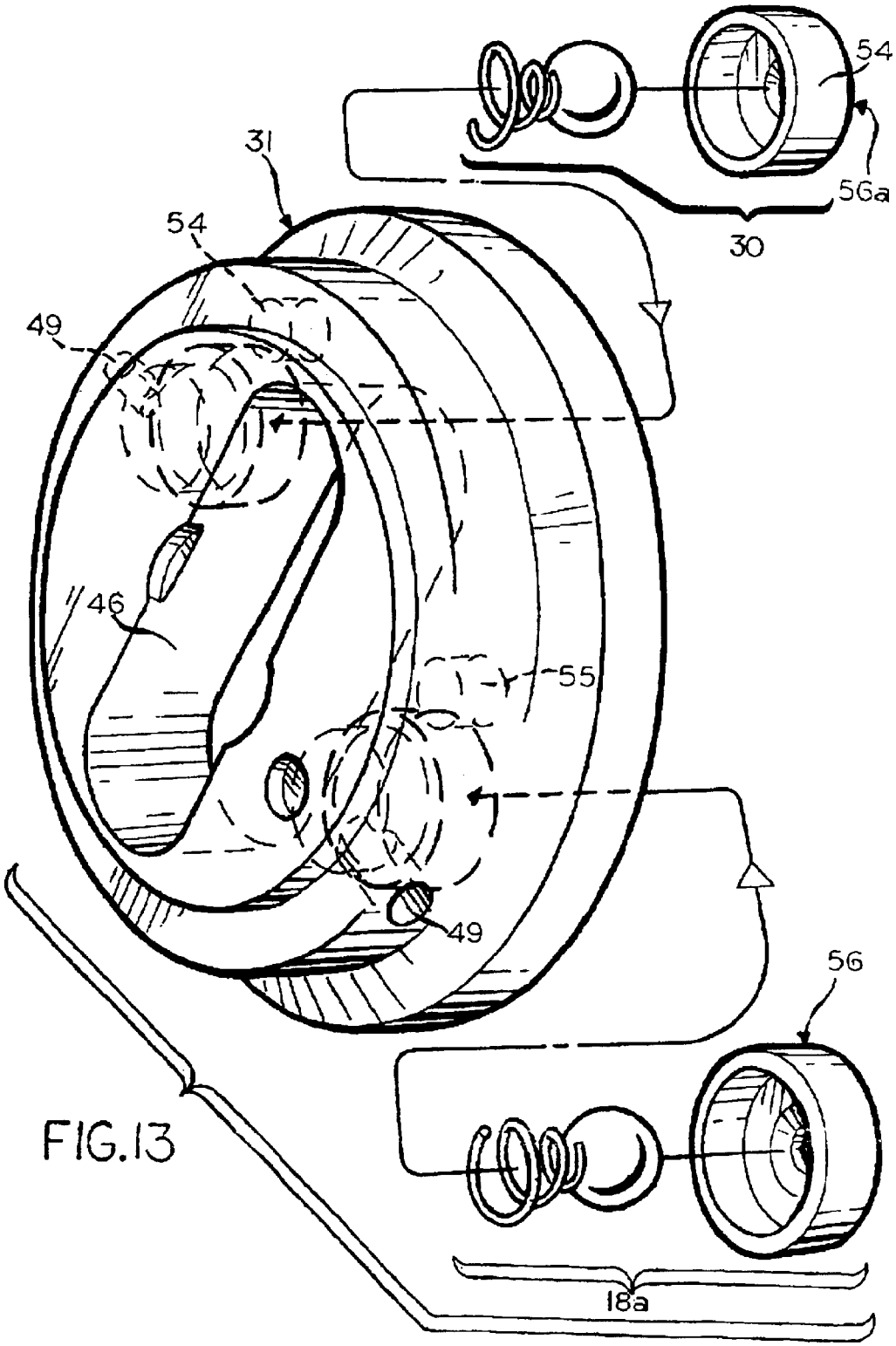

FIG. 13 is a perspective view of the left side end cap with certain parts shown in exploded relationship for purposes of clarity of illustration.

Figure 14:
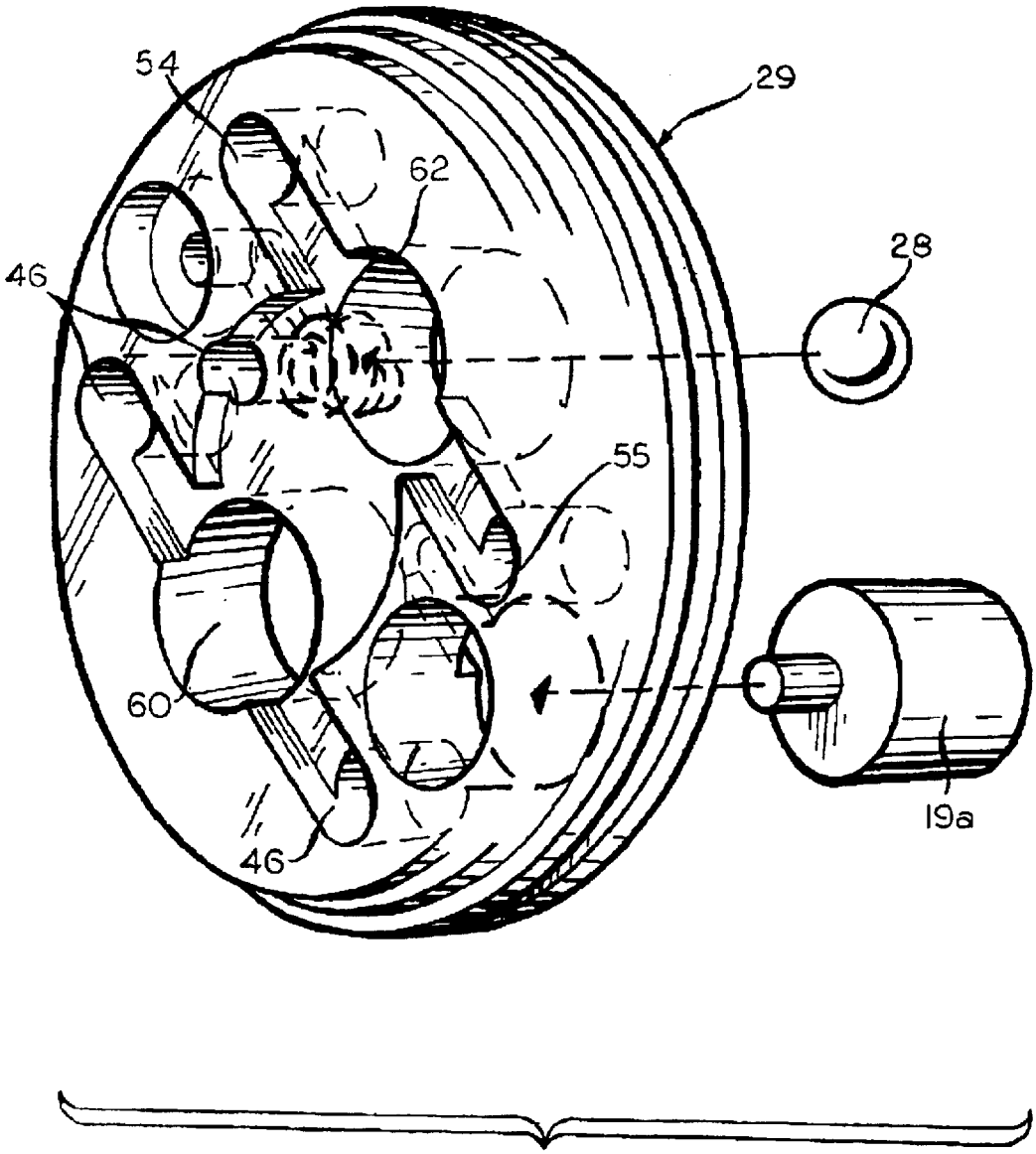

FIG. 14 is a perspective view similar to FIG. 13 and of the pump cover on the left-hand side of the pump and with certain parts shown in exploded relationship for clarity of illustration.

FIG. 15 is a sectional view, somewhat enlarged, of the pump proper taken on the Line 15–15' of FIG. 7 and is somewhat duplicative of the parts shown in FIG. 8.

Figure 16:
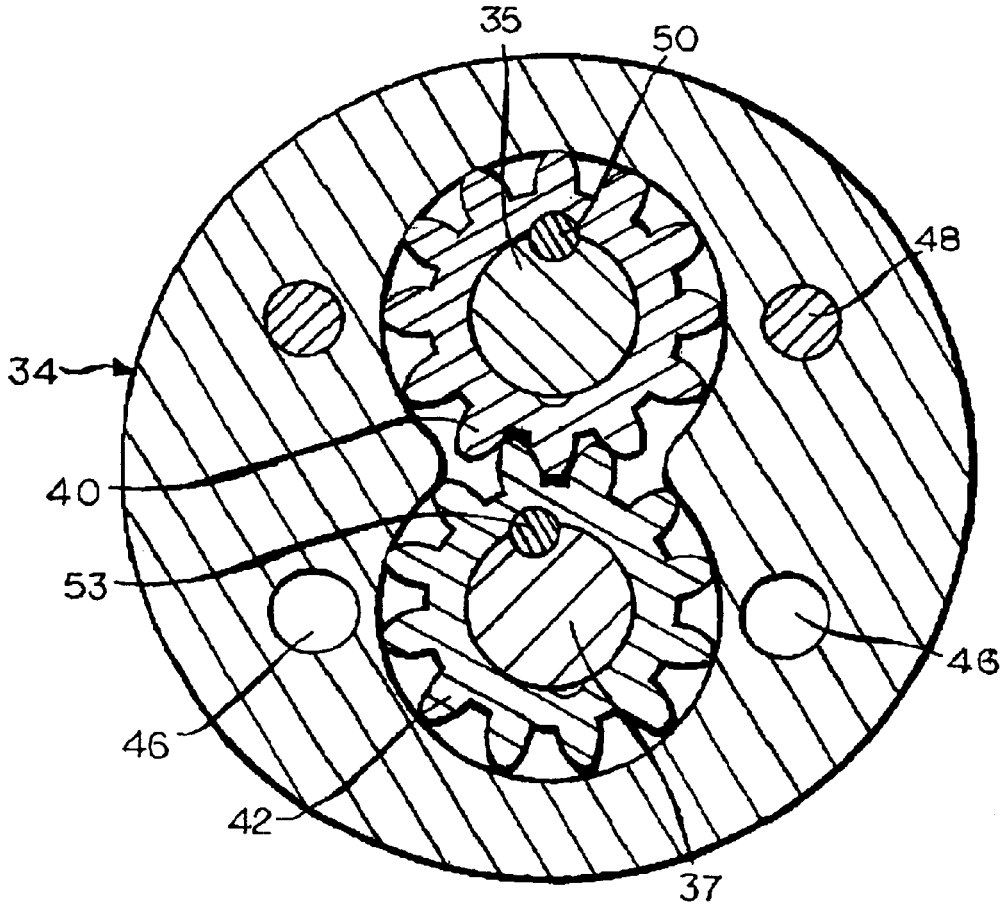

FIG. 16 is a sectional view taken on the Line 16–16' of FIG. 15 for the purpose of showing the intermeshing gears located in the cavity formed in the gear housing.

Figure 17:
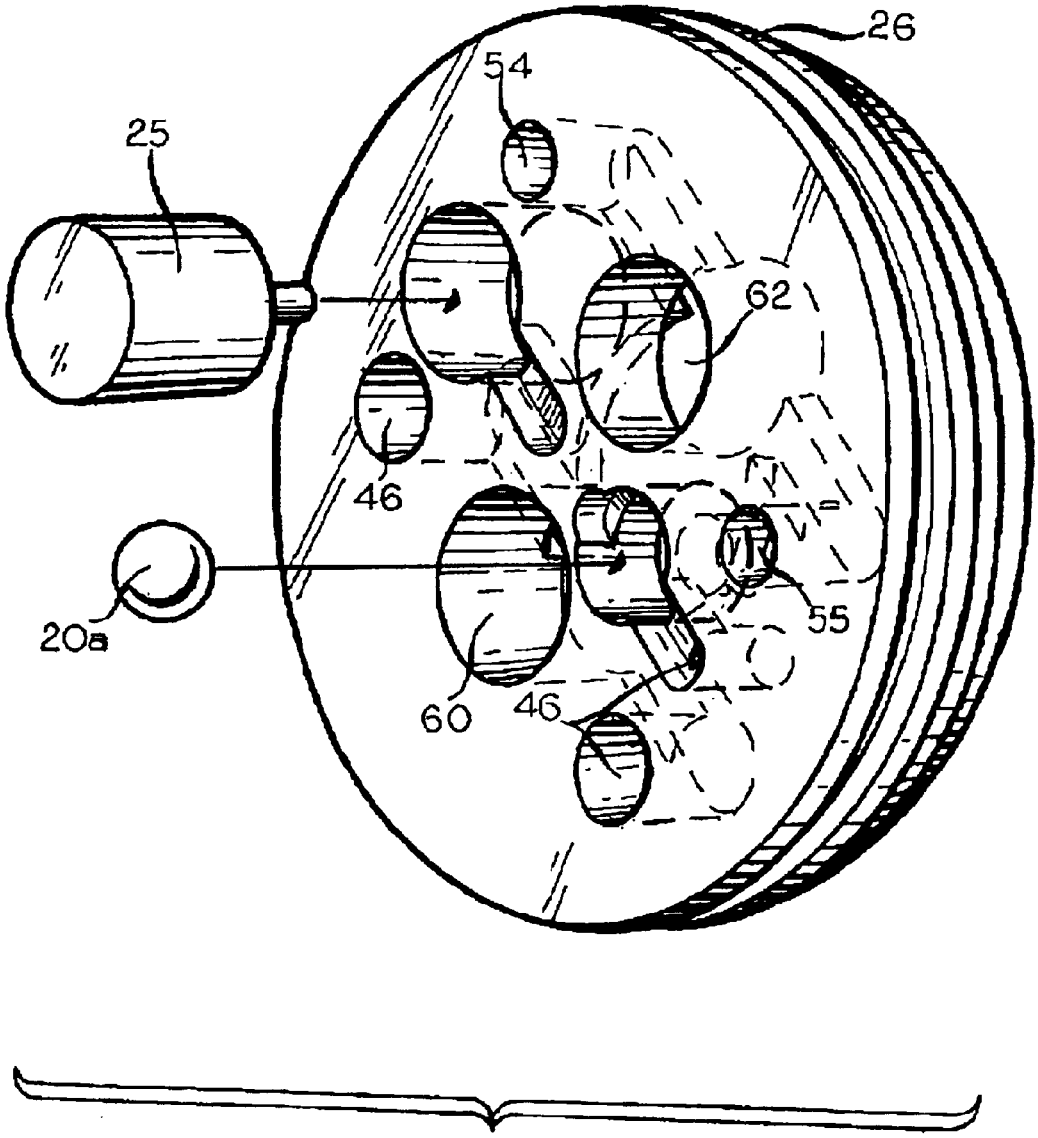

FIG. 17 is a somewhat enlarged perspective view like, FIG. 14 but of the right hand cover member of the bi-rotational pump.

Figure 18:
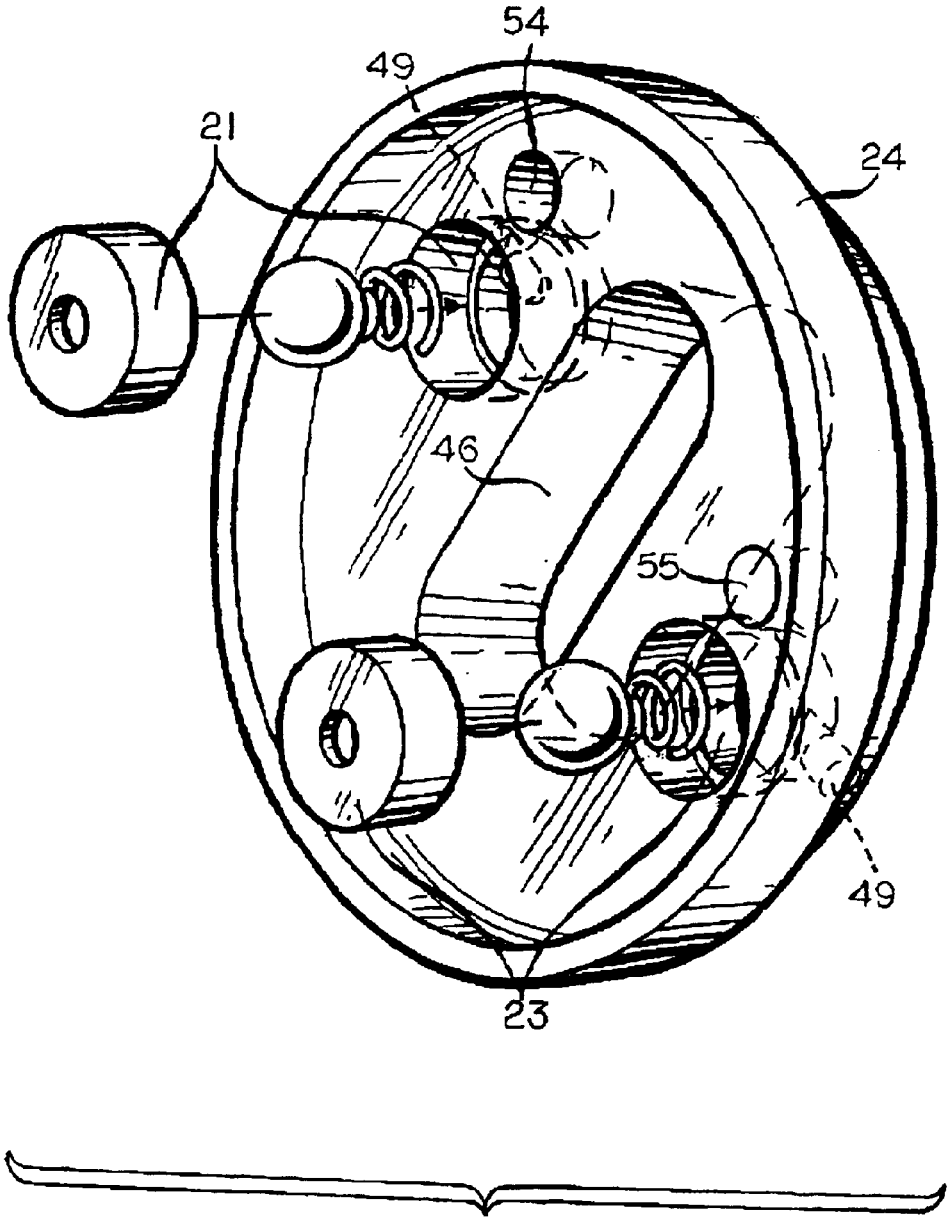

FIG. 18 is an enlarged view of the end cap on the right side of the bi-rotational pump assembly and accordingly somewhat similar to FIG. 13 but of the cap at the opposite end or on the other side of the gear housing and gear assembly.

Figure 19:
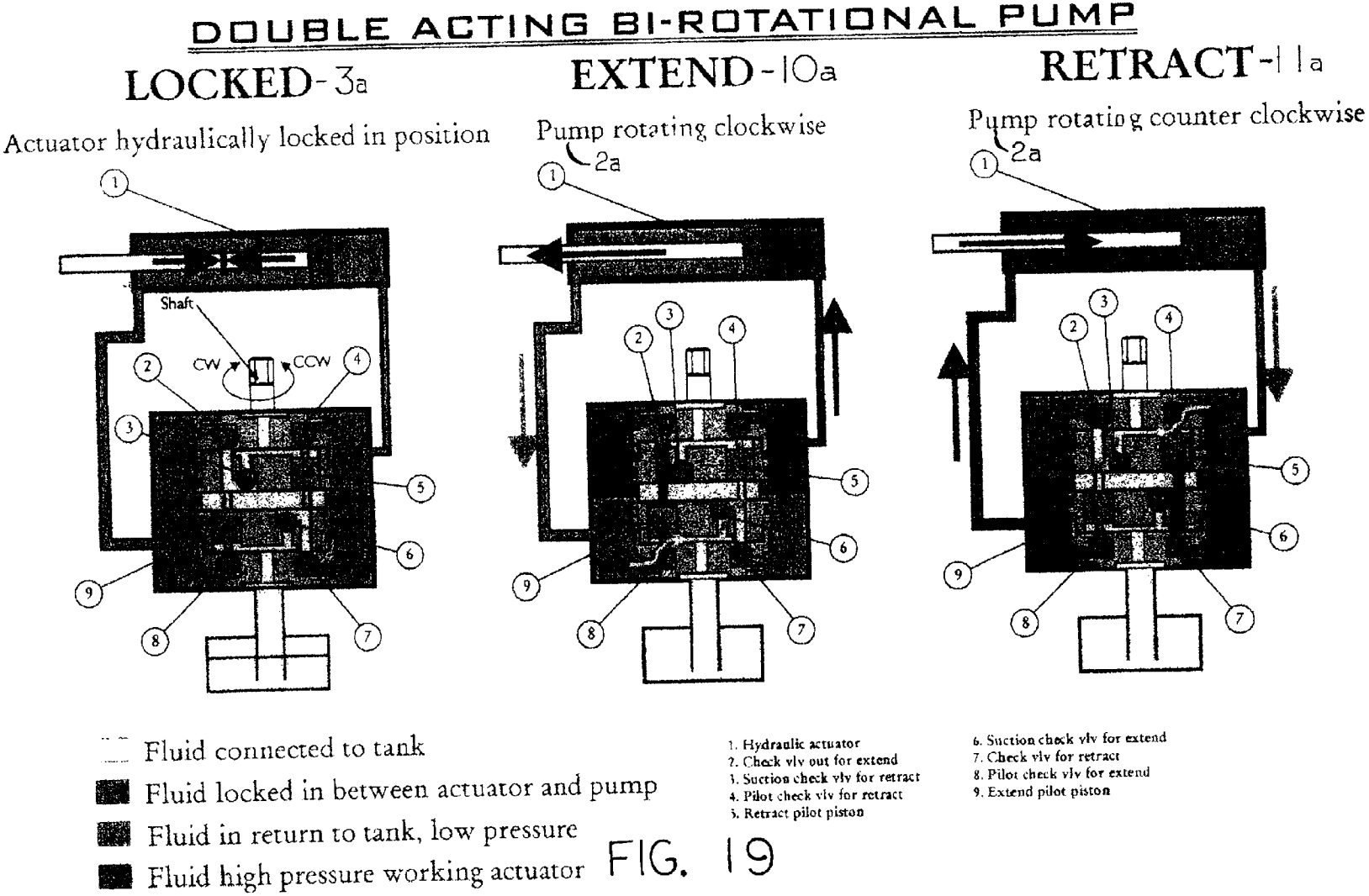

FIG. 19 is a sectional view of the pump showing the valve position and the relative direction of flow of fluid during each of three positions locked, extended and retracted.

Figure 20:
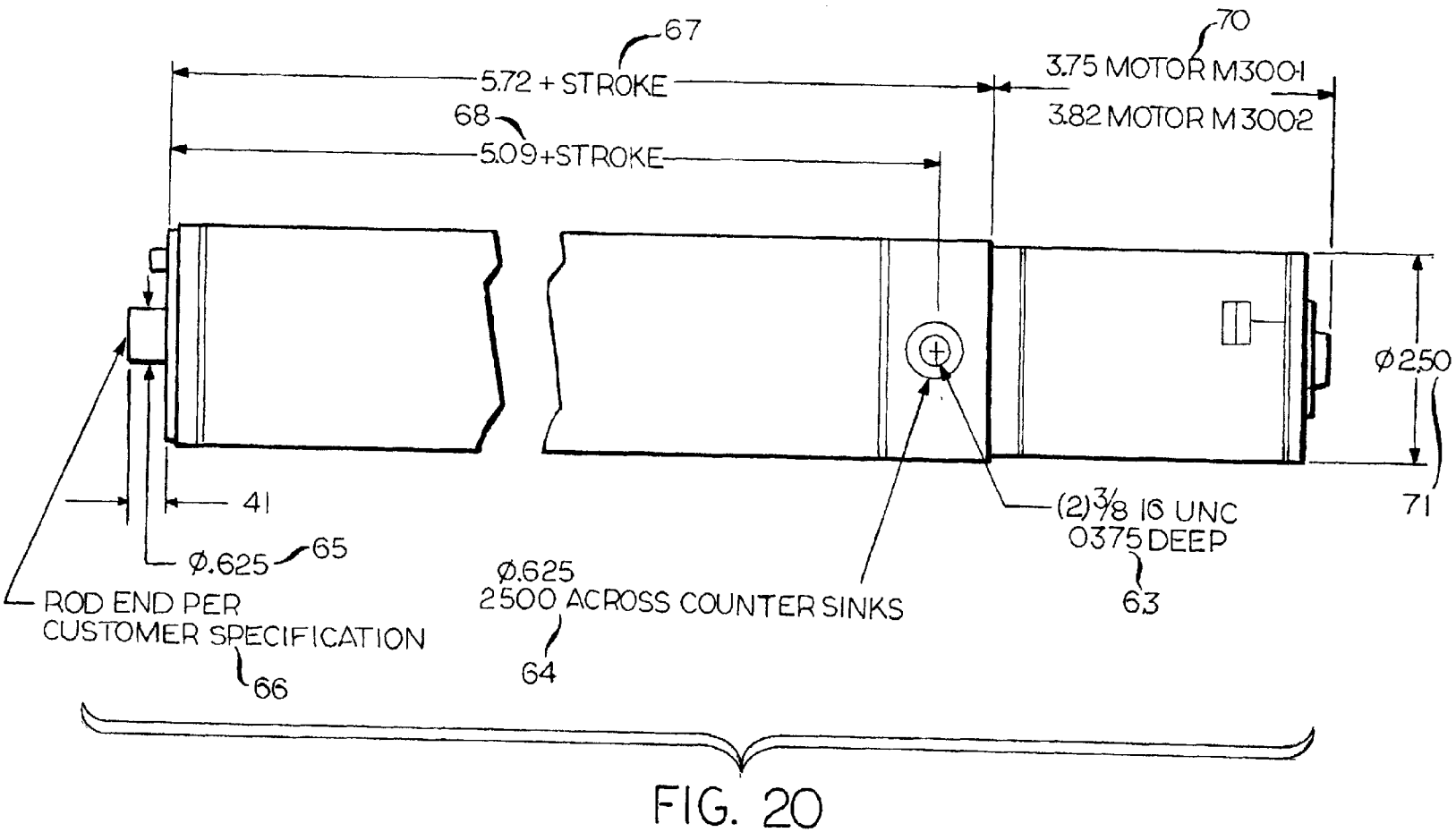

FIG. 20 is a dimensional drawing of an actuator according to the present invention.

Figure 21:
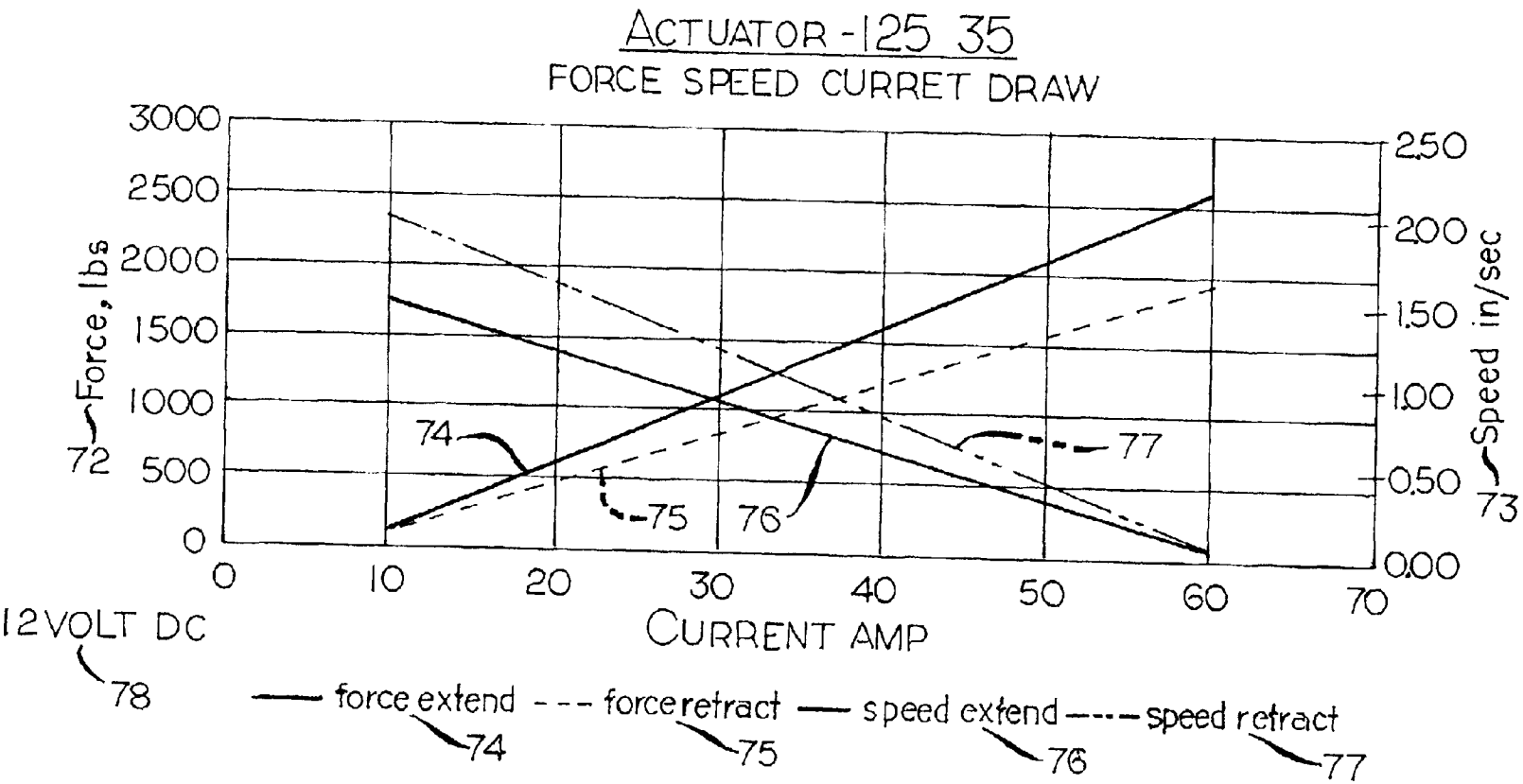

FIG. 21 is a graph of an actuator performance of the present invention in which the weight in pounds is located on the abcissa and the stroke in inches is located on the ordinate.

Figure 22:
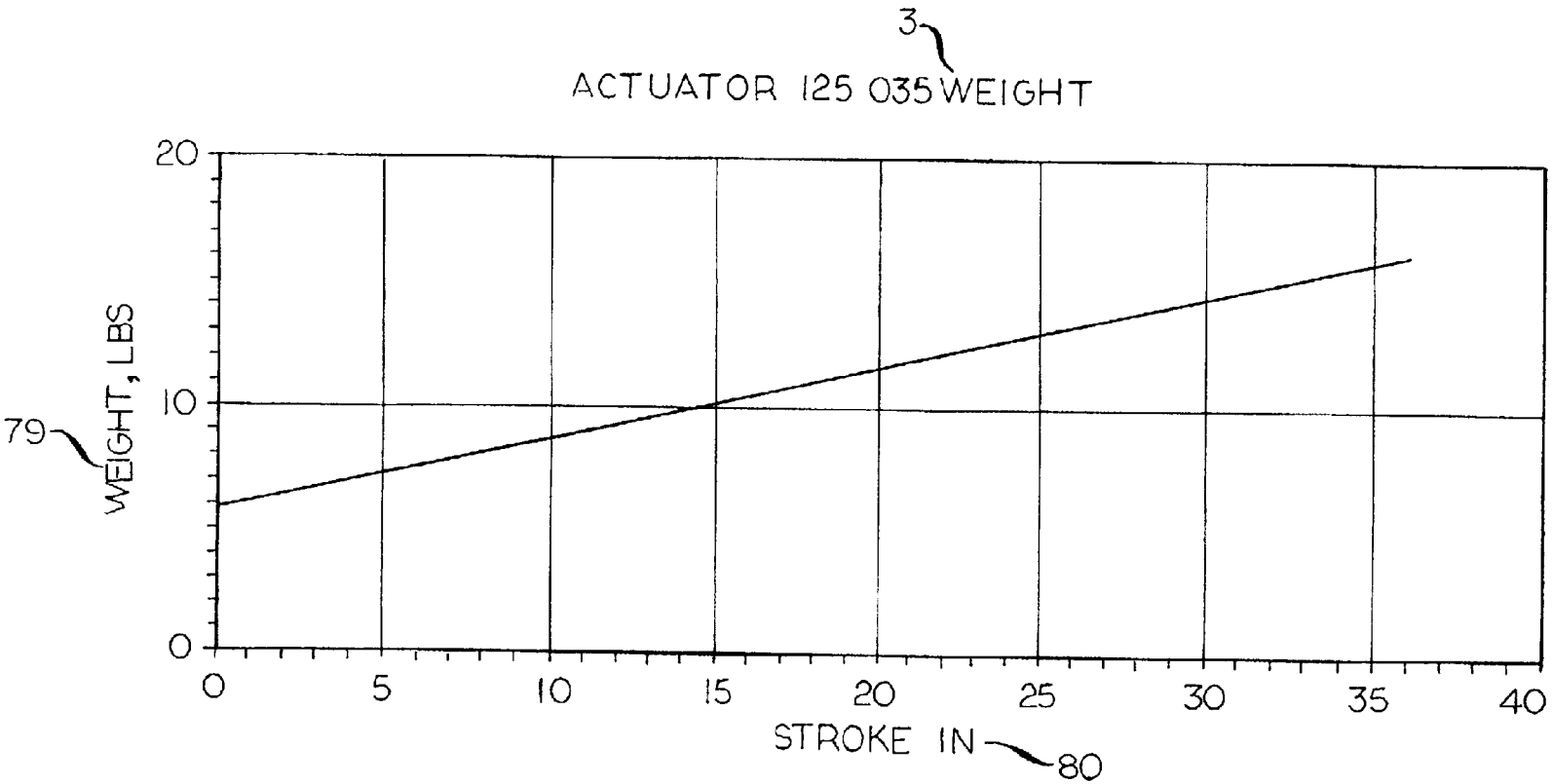

FIG. 22 is a graph of the same device representing the best mode of the present invention in speed and inches per second.

For convenience, the following Tables identify the above individual FIGURES and list the drawing numerals to the corresponding part.

FIG. 1

| | |
|---|---|
| #1a | D.C. Motor |
| #2a | Pump |
| #3a | Actuator/Cylinder |
| #4a | Piston Rod |
| #3b | Actuator Cylinder Assembly |

FIG. 2

| | |
|---|---|
| #1a | D.C. Motor |
| #5a | Relay or Manual Switch |
| #6a | Passage (Pump to piston cylinder to extend) |
| #7a | Passage (Pump to Piston Cylinder for Retract) |
| #4b | Piston |
| #9a | Cylinder For Piston |
| #4a | Piston Rod |
| #8a | Passage (Reservoir To Pump Inlet) |
| #2a | Pump |
| #13a | Reservoir |
| #45 | Guide End |
| #41 | Seal |

FIG. 3 SCHEMATIC

| | |
|---|---|
| #4a | Piston Rod |
| #4b | Piston |
| #3a | Actuator Cylinder |
| #10a | Extend |
| #11a | Retract |
| #6a | Passage To Piston Cylinder For Extend |
| #2a | Pump |
| #8a | Reservoir To Pump Inlet |
| #13a | Reservoir |
| #14a | Pump Cylinder End Cap |
| #15a | Pump Lower Chamber |
| #16a | Pump Upper Chamber |
| #7a | Passage To Piston Cylinder To Retract |

FIG. 4 SCHEMATIC (LOCKED POSITION)

| | |
|---|---|
| #4a | Piston Rod |
| #3a | Cylinder |
| #4b | Piston |
| #35 | Drive Shaft Stationary |
| #18a | Check Valve (Closed) |
| #19a | Pilot Piston |
| #20a | Check Valve (No Spring-Closed) |
| #21a | Check Valve (Open) |
| #2a | Pump |
| #13a | Reservoir |
| #14a | Pump Cylinder End Cap |
| #23 | Check Valve (Closed) |
| #24 | End Cap |
| #25 | Pilot Piston |
| #26 | Cover |
| #34 | Gear Housing |
| #28 | Check Valve (No Spring-Closed) |
| #29 | Cover |
| #30 | Check Valve (Closed) |
| #31 | End Cap |

-continued

| | |
|---|---|
| #15a | Pump Lower Chamber |
| #16a | Pump Upper Chamber |
| #8a | Passage Reservoir To Pump Inlet |

FIG. 5 SCHEMATIC (RETRACTED POSITION)

| | |
|---|---|
| #4a | Piston Rod |
| #3a | Actuator |
| #4b | Piston |
| #18a | Check (Open) |
| #32 | Pilot Piston |
| #20a | Check Valve (No Spring-Closed) |
| #21a | Check Valve (Open) |
| #2a | Pump |
| #13a | Reservoir |
| #14a | Pump Cylinder End Cap |
| #23 | Check Valve (Closed) |
| #24 | End Cap |
| #25 | Pilot Piston |
| #34 | Gear Housing |
| #28 | Check Valve (No Spring-Open) |
| #29 | Cover |
| #30 | Check Valve (Closed) |
| #31 | End Cap |
| #35 | Drive Shaft |
| #8a | Passage Reservoir To Pump Inlet |
| #6a | Passage To Piston Cylinder To Extend |
| #7a | Passage To Piston Cylinder To Retract |

FIG. 6 SCHEMATIC (EXTENDED POSITION)

| | |
|---|---|
| #4a | Piston Rod |
| #3a | Actuator |
| #4b | Piston |
| #35 | Drive Shaft (Moving Clockwise) |
| #18a | Check Valve |
| #19a | Pilot Piston |
| #20a | Check Valve (No Spring-Open) |
| #21a | Check Valve (Closed) |
| #2a | Pump |
| #13a | Reservoir |
| #14a | Pump Cylinder End Cap |
| #23 | Check valve (Open) |
| #24 | End Cap |
| #25 | Pilot Piston |
| #26 | Cover |
| #34 | Gear Housing |
| #28 | Check Valve (No Spring-Closed) |
| #29 | Cover |
| #30 | Check Valve (Open) |
| #31 | End Cap |
| #6a | Passage to Piston Cylinder to Extend |
| #7a | Passage to Piston Cylinder to Retract |
| #8a | Passage reservoir To Pump Inlet |

FIG. 7 MOTOR END OF PUMP WITHOUT PUMP RETAINER

| | |
|---|---|
| #35 | Drive Shaft |
| #37 | Idler Shaft |
| #4c | Motor End of Pump (Without Pump Retainer) |

FIG. 8 TOP ONE HALF of PUMP WITH RETAINER

| | |
|---|---|
| #35 | Drive Shaft |
| #39 | Pump Retainer |
| #18a | Check Valve |
| #2a | Pump |
| #31 | End Cap |
| #29 | Cover |
| #26 | Cover |
| #24 | End Cap |
| #25 | Pilot Piston |
| #20a | Check Valve (No Spring) |
| #21a | Check Valve |
| #23 | Check Valve |
| #19a | Pilot Piston |
| #40 | Gear Only |
| #2a/39 | Pump with Pump Retainer |
| #28 | Check Valve (No Spring) |
| #30 | Check Valve |
| #39a | Pump Retainer |
| #35 | Drive Shaft |

-continued

FIG. 9

| | |
|---|---|
| 1a | Motor |
| #35 | Drive Shaft to Motor |
| #40 | Gear |
| #6a | Passage (pressure to extend) |
| #4a | Piston |
| #4b | Piston Rod |
| #7a | Passage to Piston Cylinder to Retract |
| #41 | Seal |
| #24 | End Cap |
| #13a | Oil Reservoir |
| #8a | Passage Inlet |
| #14a | Pump Cylinder End Cap |
| #37 | Idler Shaft |
| #26 | Cover |
| #2a | Pump |
| #42 | Gear |
| #29 | Cover |
| #43 | Pump Retainer |
| #31 | End Cap |

FIG. 10

| | |
|---|---|
| #6a | Passage to Cylinder for Extend |
| #44 | Plug |
| #4a | Piston Rod |
| #45 | Guide End |
| #9a | CYL for Piston Rod |
| #13a | Oil Reservoir |
| #45a | O-Ring |

FIG. 11 DRIVE END PARTS

| | |
|---|---|
| #46 | Opening |
| #31 | End Cap |
| #29 | Cover |
| #47 | Dowel Pin |
| #35 | Drive Shaft |
| #37 | Idler Shaft |
| #48 | Dowel Pin |
| #25 | Pilot Piston |
| #49 | Outlet |

FIG. 12

| | |
|---|---|
| #35 | Drive Shaft |
| #47 | Dowel Pin |
| #50 | Gear Key Ball |
| #40 | Gear |
| #34 | Gear Housing |
| #21a | Pilot Piston |
| #26 | Cover |
| #28 | Check Valve (In Place) |
| #24 | End Cap |
| #6a | Opening |
| #18a | Check Valve (In Place) |
| #20a | Check Valve (No Spring) |
| #42 | Gear |
| #48 | Dowel Pin |
| #53 | Gear Key Ball |
| #37 | Idler Shaft |

FIG. 13 (END CAP)

| | |
|---|---|
| #46 | Opening |
| #7a | Fluid Passage to Cylinder to Retract |
| #54 | Hole For Dowel Pin |
| #30 | Check Valve |
| #55 | Hole For Dowel Pin |
| #49 | Outlet Fluid Passage |
| #56 | Check Valve Seat |
| #18a | Check Valve |
| #56a | Check Valve Seats |
| #31 | End Cap |

FIG. 14 (COVER)

| | |
|---|---|
| #7a | Fluid Passage to Cylinder to Retract |
| #60 | Hole For Idler Shaft |
| #7a | Fluid Passage |
| #54 | Hole For Dowel Pin |
| #58 | Hole For Drive Shaft |
| #20a | Check Valve (No Spring) |

-continued

| | |
|---|---|
| #55 | Hole For Dowel Pin |
| #19a | Pilot Piston |
| #29 | Cover |
| | FIG. 15 PUMP |
| #2a | Pump |
| #39 | Pump Retainer |
| #46 | Opening |
| #35 | Drive Shaft To Motor |
| #31 | End Cap |
| #29 | Cover |
| #34 | Gear Housing |
| #26 | Cover |
| #24 | End Cap |
| #40 | Gear |
| #58 | Gear Key Ball |
| #6a | Opening |
| #59 | Gear Key Ball |
| #42 | Gear |
| #37 | Idler Shaft |
| | FIG. 16 |
| #42 | Gear |
| #7a | Fluid Passageway |
| #53 | Gear Key Ball |
| #40 | Gear |
| #34 | Gear Housing |
| #61 | Dowel Pin |
| #35 | Drive Shaft To Motor |
| #50 | Gear Key Ball |
| #48 | Dowel Pin |
| #7a | Fluid Passageway |
| #37 | Idler Shaft |
| | FIG. 17 (Cover) |
| #7a | Fluid Passage |
| #60 | Hole For Idler Shaft |
| #20a | Ball Valve (No Spring) |
| #46 | Fluid Passage |
| #25 | Pilot Piston |
| #54 | Hole For Dowel Pin |
| #62 | Drive Shaft |
| #55 | Hole For Dowel Pin |
| | FIG. 18 END CAP |
| #53 | Ball Valve |
| #50 | Ball Valve |
| #7a | Fluid Passage |
| #54 | Hole For Dowel Pin |
| #6a | Opening |
| #55 | Hole For Dowel Pin |
| #7a | Fluid Passage |
| | FIG. 19 |
| #3a | LOCKED/Actuator hydraulically locked into position |
| #2a/10a | EXTEND/Pump rotating clockwise |
| #2a/11a | RETRACT/Pump rotating counterclockwise |
| | FIG. 20 |
| #63 | (2) 3/8-16 UNC 0.375 DEEP |
| #64 | Ø.625 2.500 ACROSS COUNTER SINKS |
| #65 | Ø.625 |
| #66 | ROD END PER CUSTOMER SPECIFICATIONS |
| #67 | 5.72 + STROKE |
| #68 | 5.09 + STROKE |
| #70 | 3.75 MOTOR M300-1<br>3.82OTOR M300-2 |
| #71 | Ø2.50 |
| | FIG. 21 ACTUATOR 125-35 Force, Speed Current Draw |
| #72 | Force No's. |
| #73 | Speed, in/sec |
| #74 | Force extend |
| #75 | Force Retract |

-continued

| | |
|---|---|
| #76 | Speed Extend |
| #77 | Speed Retract |
| #78 | 12 Volt DC |
| | FIG. 22 |
| #3a | ACTUATOR 125-035 WEIGHT |
| #79 | WEIGHT, LBS |
| #80 | STROKE, IN |

In its simplest embodiment, the present invention contemplates a bi-rotational gear pump comprising a generally circular gear housing having a generally central cavity contoured for a pair of intermeshing gears carried concentrically respectively on a drive shaft and a parallel idler shaft spaced from said drive shaft sufficiently to allow intermeshing rotation of said gears in either direction to move fluid in either direction; a pair of generally circular cover members situated concentrically in flush abutment on either side of said gear housing and a pair of generally circular end cap members in concentric flush abutment on either side of said cover members; said cover members and end cap members, on either side, containing a series of connected internal passageways and defining one inlet fluidly connected to said intermeshing gears, and two outlets, one for each rotational (clockwise or counterclockwise) movement of said intermeshing gears. The outlets are adapted for fluid connection with a hydraulic cylinder on either side of a piston and connected piston rod, the latter being reciprocal. Said passageways include a plurality of ball/check valve means constructed and arranged (together with appropriate valve seats) to control/direct fluid to one or the other of said outlets depending upon the rotational movement of said intermeshing gears in clockwise or counterclockwise (or stationary position) and means enclosing said bi-rotational pump such that the pump parts are surrounded by the fluid being pumped, said fluid exhibiting the pressure developed by the pump itself.

In accordance with a further embodiment of the present invention the pump includes means for directing said pumped fluid through either of said outlets, depending upon the rotation of the pump, and then via appropriate passageways/conduits to a hydraulic cylinder or actuator containing a linear shaft and connected piston moving in either direction responsive to the fluid introduced into the actuator interior; and further characterized in that said bi-rotational pump is carried in a surrounding shell defining a space or volume/reservoir fluidly connected to said passageways of said pump formed in said cover and end cap members and including the conduit direction of fluid from either of said aforesaid outlets to the corresponding actuator cylinder.

According to another embodiment of the present invention, the pump includes means connected thereto for mounting same in an actuator cylinder in generally coaxial relationship with the piston rod and the shaft of an electrically driven motor controlled by a three position switch or relay such that the motor will remain at rest or will rotate in one direction and then the other direction responsive to said switch or relay position. The switch (relay) may be manually controlled or any timer or other means.

DESCRIPTION

Referring now specifically to the drawings, there is disclosed in FIG. 1, a side elevation view of a actuator/cylinder assembly (3*b*) inclusive of a electric motor (1*a*) at one end, a piston (4*b*) and piston rod (4*a*) assembly at the other end, and intermediate, a bi-rotational pump (2*a*) in accordance of the present invention.

FIG. 2 is a perspective view, of the elements of FIG. 1, with portions broken away, for the purpose of showing the interior positioning of the pump (2*a*) in the actuator/cylinder (3*a*) and the flow of fluids, usually hydraulic oil, in the actuator (3*a*), piston (4*a*) and cylinder (9*a*) and the surrounding annular void (13*a*) serving as an oil reservoir. Also shown are passageways leading from reservoir (13*a*) via an inlet (8*a*) to the pump (2*a*) and outlets (6*a*, 7*a*) fluidly leading to one side or the other of the piston (4*b*) axially disposed in the actuator (3*a*).

For purposes of clarity FIG. 3 is schematic in that the bi-rotational pump (2*a*) and its reservoir enclosure (13*a*) and the actuator cylinder (3*a*), including piston rod (4*a*) and piston (4*b*) are shown in distinct, spaced relationship. The reservoir (13*a*) is connected to bi-rotational pump (2*a*) by an inlet (8*a*) leading to the interior of the pump (2*a*). The pump (2*a*), depending on the clockwise (cw) or counterclockwise (ccw) direction it is rotating, discharges pressurized fluid to the upper (16*a*) or lower (15*a*) chamber of the pump enclosure and then, by suitable Internal passageways, to the actuator cylinder (3*a*) thereabove, to which it connects on either one side or the other of the piston which moves the piston rod (4*b*) to and fro to the left and to the right depending on the hydraulic pressure developed by appropriate rotational movement of the gears (not shown).

FIG. 4, as noted in TABLE X, represents a "no rotation" position of the drive shaft (35) and wherein valves (23), (18*a*), (21*a*) and (30) are closed. They are closed because with "no rotation" of the driveshaft (35) there is no pressure in either chamber (15*a*) or (16*a*) to actuate the pilot pistons (19*a*) of (25), either of which would open the corresponding valves (18*a*) or (23) respectively. Likewise valves (30) and (21*a*) are closed and held closed by the spring as shown because there is no pressure to overcome the resistance of the spring holding the respective valves (30) and (21*a*) in the closed position. The closed position represents a locked position.

The accompanying FIG. 19 illustrates the valve positions and flow of fluid respecting FIGS. 4, 5, and 6.

Referring to FIG. 5 the position of the parts such as ball valves etc. are the result of counterclockwise (ccw) movement of the pump shaft (35) whereby pressure is developed in the lower half (15*a*) of the pump (2*a*) and moves fluid up the left outlet to the interior of the cylinder/actuator (3*a*) causing movement of the piston (4*b*) and connecting rod (4*a*) to the right to the retract position. At the same time the hydraulic fluid on the other side of the piston (4*a*) is moving downwardly to the upper chamber (16*a*) and through the pump (2*a*) in a manner illustrated by the arrows and open position of the ball valves (28, 18*a*, 20*a*) and the arrows and the closed position of ball valves (23, 30, 20*a*).

Referring now to FIG. 6 and TABLE X, the drive shaft (35) is rotating in a clockwise (cw) direction of rotation, which is the reverse of the counterclockwise (ccw) direction shown in FIG. 5. This change in direction of rotation results in a pressure being immediately urged against pilot piston (25), which moves downwardly against spring opposed ball (23), thereby opening the associated valve (23) and in addition valves (30) and (20*a*) as shown. The continued clockwise (cw) rotation of the drive shaft (35) also closes ball valves (28, 18*a*, 21*a*). And as a consequence there is a change of pressure whereby the pressure is greater in the fluid flow into upper chamber (16*a*) causing the fluid to flow out conduit (7*a*) upwardly into the actuator (3*a*) to the left of piston (4*b*) causing piston (4*b*) to move to the right into the retract position. This in turn moves liquid out of the opposite end of the actuator (3*a*) down conduit (6*a*) into the lower chamber (15*a*) and through valve (23) to the reservoir (13*a*) thereby initiating a reversal to the FIG. 5 conditions by reason of changing the rotation of pump (2*a*) from clockwise (cw) to counterclock (ccw).

It my be stated at this juncture, that it is a particular feature of the present invention that the entire system is essentially filled with fluid, such that the hydraulic pressure is the same throughout thus supporting the exterior surfaces of the pump (2*a*) whereby the pump components may be made smaller structurally through the support of the surrounding fluid and the hydraulic pressure developed therein. The pump may be mounted in a block of such a small size, which was not possible with prior art.

It is this feature that allows the pump structure (2*a*) to be made so small as to fit within the actuator cylinder (3*a*) rather than exteriorally as in the usual case in the art as of today.

With the understanding gained by the foregoing hydraulic language/description, relative to FIGS. 1 thru 6; it is believed that the remainder of the Figs., particularly FIG. 7 through 18, will be readily understood by referring to the drawings. Thus the drawings in FIGS. 7 through 18 are based upon and illustrate actual, individual component parts and assemblies, but shown about 3 times larger than actual size. In these specific drawings, it is recommended that FIG. 7, FIG. 8 and FIG. 15 be viewed together and which respectively show an end view and sectional views of the pump proper (2*a*) showing the motor drive shaft (35) and the parallel spaced idler shaft (37). In FIGS. 8 and 15 the gears (40/42) and gear housing (34) have flushly situated, on either side, cover members (26/29) and outward of the cover members (26/29) are flushly situated end cap members (31/24) left and right.

FIG. 15 shows gear key balls (58/59) serving as a lock key securing the gears (40/42) to the drive shaft (35) and idler shaft (37) thus turns the gears (40/42) in a clockwise (cw) or counterclockwise (ccw) rotation. The pump (2*a*) components consisting of gears (40/42), and covers (26/29) and end caps (31/24) members on either side of gear housing (34).

Referring to FIG. 9, the oil reservoir (13*a*), via the inlet (passage 8*a*), as connected fluidly to the central portion of the pump (2*a*), as quite clearly illustrated; as are the outlets respectively identified as passageway (6*a* and 7*a*). Now as shown in FIGS. 2 and 9, passage (6*a*) connects the outlet of the pump (2*a*) to the actuator cylinder (3*a*) on the extended side of the piston (2*a*) to achieve extension of the piston rod (4*b*); while passage (7*a*) connects the pump outlet assuming counterclockwise (ccw) movement of the drive shaft) to carry the liquid to the cylinder, as shown, at the extremity of the cylinder to achieve movement of the piston/shaft (4*b*/4*a*) to the left and thus in a retracting movement.

FIG. 8 is a sectional view of the top half of the pump (2*a*) and shows clearly the pump retainers (14*a*/39) at each end and exteriorly of the end cap members (31/34).

FIG. 10 shows the oil reservoir spaces (13*a*) surrounding the piston rod/cylinder (9*a*) and the journeling of the right or terminal end of the piston rod (4*a*) and the outer end (6*a*) of the cylinder (9*a*). This Fig. also shows passage (7*a*) delivering hydraulic fluid under pressure to the terminal end of the piston rod (4*a*) and cylinder (9*a*) arrangement. These parts are shown generally in fluid sealed relationship mounted in the guide end (45) identified in FIG. 10.

FIG. 11 shows in detail the relationship of the generally circular and coaxially mounted end cap (31) and cover (29) with the openings for the drive shaft (35) and idler shaft (37) as well as the registration-locating dowel pins (47/48).

FIG. 12 is like FIG. 11 but shows the component parts particularly the gear housing (34), the right hand cover (26) and right hand end cap (24), in exploded perspective view, to show the dowel pins (47/48), the idler shaft (37) and the drive shaft (35) the gears (40/42), and a passageway (6*a*) for the fluid. Ball type check valves (28 and 18*a*), the pilot piston (21*a*) and check valve with no spring (20*a*) are also shown in FIG. 12 due to the exploded nature of the drawings.

FIG. 13 is also an exploded view, somewhat enlarged, of the left side end cap (31) and the opening (46) necessary to accommodate the drive shaft (35), and idler shaft (37) and openings (54/55) for dowel pins (47/48) respectively. FIG. 13 also shows the outlet fluid passage (49).

FIG. 14 is like FIG. 13, that is, exploded, and shows the left hand cover member (24) and, as well, a pilot piston (19*a*) and the spring-opposed ball check valve (20*a*).

FIG. 16 shows the gear housing (34) and the gears (40/42) as well as the lock balls (50/53), serving as keys, connecting gears to the shafts (35/37) and as well the dowel pins (61/48) location for registration of these component parts flushly together.

FIG. 17 is useful in understanding the construction of the right hand cover member (26) adjacent the gear housing (34), and, as well, the holes (54/55) for seating the dowel pins for registration plus the machined holes (60/62) for the drive shaft (35) and idler shaft (60) are shown.

In FIG. 18 there is shown, in enlarged perspective, the right hand cap member (26). This Figure is also noteworthy, in illustrating the inlet fluid passageway (7*a*) and the outlet fluid passage (7*b*) for the fluid caused by the rotation of the gears (40/42) and directing fluid under pressure as indicated in FIG. 2 to the outer or terminal end of the actuator (3*b*).

This basic pump design can be as a single rotational pump with one output flow, where all check valves and pilot pistons are deleted. This pump would be very light and compact. See sketch provided with the material with the application.

Hereinabove, considerable focus, attention and description has been placed upon the embodiment of the invention comprising the double acting bi-rotational pump in combination with piston and cylinder actuator; but it should be appreciated that the bi-rotational pump has considerable utility and application for use in and of itself. The bi-rotational pump enclosed in a suitable jacket or enclosure, including means defining voids for use as a reservoir will find many applications wherein the direction of the pump is maintained almost exclusively in either clockwise movement of the gears as directed by the electric motor or in counterclockwise movement.

To do this it will be necessary to supply a continuing supply of hydraulic fluid or arrange for some of the fluid exiting one of the outlets to be re-circulated to the inlet. Thus the pump could be used for incremental movement of fluid in one direction only by use of an electric switch or relay which has simply 2 positions; an at rest position and a clockwise or a counterclockwise position. Such a pump would have all the advantages of a gear pump plus the additional advantages provided by the present gear pump in having its pressure exerted on its outside surfaces as well as in the internal conduits.

Along with this advantage would be the miniaturization of the components which would be available due to the feature of the bi-rotational pump as described hereinabove.

It would of course also be possible to plug or delete the passageways leading to one of the outlets. In this fashion there would only be one outlet which could be directed through appropriate conduit to any destination desired. One example would be to enclose the bi-rotational pump with one outlet plugged into a conduit with suitable arrangements for direct current rotation of the drive shaft. A plurality of such arrangements would provide pumping energy to be exerted upon fluids to be conveyed a long distance more efficiently than with a single gear pump located at the inlet end of the conduit under consideration.

From the foregoing drawings, and the general and specific descriptions, it will be appreciated that significant advantageous features of the present invention reside in the unique design of the multi-component gear pump; including its coaxially mounted members on either side, which provide/include flow of fluid in different directions by reason of a unique selection and arrangement of spring opposed-ball check valves and ball check valves which are not spring opposed. These are arranged in a novel fashion to define different flows of fluid as controlled by the position of ball check valves and certain pilot pistons controlled by a ball check valve which are not spring opposed. All of these by their location and control cooperate to provide a flow of fluid and corresponding pressure in one direction or the other depending on the rotation of the drive shaft of the pump controlled in turn by an electric motor, having controlled to off, on right, or on, on the left.

This combination of features provides reliable and positive reversible rotation of the gear pumps and by reason thereof a reversible flow of fluid for example, to different sides of a piston in a piston driven mechanism all in a manner not known heretofore in the art.

Compounding these features is that they provide a reduction in the size, as noted in the Specification hereinandabove, which suggests and promotes its usage in a wide variety of hitherto unknown/unrealized applications.

From the foregoing description, specification and in combination with the drawings; it will be appreciated that many obvious changes and modifications will become apparent to those skilled in the art and all those obvious modifications and changes are intended to be included within the scope of the present invention unless such would do violence to the scope of the appended claims.

What is claimed is:

1. An improved bi-rotational gear pump generally comprising a generally circular or annular gear housing defining a central cavity; adapted and sized to receive a pair of intermeshing gears carried axially by drive means, rotating in a "cw" or "ccw" direction and thereby pumping liquid through said pump depending upon the rotation of said drive means, a pair of generally circular cover members situated concentrically in flush abutment, on either side of said gear housing, a pair of generally circular end-cap members in concentric flush abutment on either side of said cover members; said cover members and said end cap members each being machined so as to define together a plurality of interconnected, internal passageways, an inlet means for fluid leading to said pair of intermeshing gears, and two outlet means for pumped fluid and means for directing said fluid to one or other of said outlet means depending on the direction of rotation of said intermeshing gears.

2. The invention as claimed in claim 1 wherein the series of connected internal passageways includes an array of ball valves which are constructed and arranged to open or close depending upon the rotational movement of the intermeshing gears and consequent movement of the fluid.

3. The invention as claimed in claim 2 and further comprising a plurality of valves located within said connected internal passageways and means for controlling said ball valves as to change the movement of said fluid through internal passageways.

4. The invention as claimed in claim 3 and further comprising a pilot type piston located in at least one of the valves serving to open or close the valve in question.

* * * * *